US007131597B2

(12) United States Patent
Scattergood

(10) Patent No.: US 7,131,597 B2
(45) Date of Patent: Nov. 7, 2006

(54) ATOMIZATION TECHNIQUE FOR PRODUCING FINE PARTICLES

(76) Inventor: John R. Scattergood, 111 Clearwater Dr., LaGrange, GA (US) 30241-1523

( * ) Notice: Subject to any disclaimer, the term of this patent is extended or adjusted under 35 U.S.C. 154(b) by 206 days.

(21) Appl. No.: 10/658,250

(22) Filed: Sep. 9, 2003

(65) Prior Publication Data

US 2005/0050993 A1 Mar. 10, 2005

(51) Int. Cl.
*A62C 5/02* (2006.01)
*B05B 1/24* (2006.01)

(52) U.S. Cl. ..... 239/8; 239/9; 239/10; 239/13; 239/224; 239/398; 239/418; 239/135; 75/333; 75/334; 75/338

(58) Field of Classification Search ..... 239/110, 239/224, 8, 9, 10, 398; 75/333, 335, 334, 75/338; 219/121.5; 264/8
See application file for complete search history.

(56) References Cited

U.S. PATENT DOCUMENTS 2,439,772 A * 4/1948 Gow ..... 264/8
3,151,971 A * 10/1964 Clough ..... 75/344

(Continued)

OTHER PUBLICATIONS

German, "Power Metallurgy Scince."

(Continued)

*Primary Examiner*—Dinh Q. Nguyen
(74) *Attorney, Agent, or Firm*—Thomas, Kayden, Horstemeyer & Risley, LLP

(57) ABSTRACT

This disclosure relates to a novel process for atomizing a liquid material or a mixture of liquid materials. More specifically, this disclosure advances the art by utilizing the inertial forces created in an elevated acceleration environment to further miniaturize and enhance the characteristics of particles resulting from atomization. The key to this disclosure is to subject a melt material to an elevated acceleration and pass a fluid over the surface of the melt. The purpose of the elevated acceleration is to elevate the relative importance of gravitational forces in the melt thus miniaturizing any gravity influenced disturbance. This elevated acceleration environment leads to miniaturization of gravitationally dependent phenomena thus leading to smaller particle creation. The purpose of the atomizing fluid is to impart kinetic energy onto the melt thereby causing disturbances and to act as a heat transfer media to cool the particles. In other words, this disclosure teaches not only utilizing bursting bubbles, surface waves, and splashes to create fine particles by purposely introducing gas flow on the liquid material(s) to be atomized but further enhancing the process by facilitating that these material(s) are simultaneously at elevated acceleration. The novel aspects of this disclosure significantly enhance the physical characteristics of the resulting particles, by allowing smaller particles to be produced, by cooling the particles more rapidly and by reducing contamination threats by avoiding physical contact between the material(s) being atomized and any refractive materials.

33 Claims, 25 Drawing Sheets

U.S. PATENT DOCUMENTS

| | | | | | |
|---|---|---|---|---|---|
| 3,617,587 | A | * | 11/1971 | Nayar et al. | 75/333 |
| 4,025,249 | A | * | 5/1977 | King | 425/6 |
| 4,088,429 | A | * | 5/1978 | Helton et al. | 425/8 |
| 4,343,750 | A | * | 8/1982 | Holiday et al. | 75/334 |
| 4,355,057 | A | * | 10/1982 | Slaughter | 427/216 |
| 4,394,332 | A | * | 7/1983 | Raman et al. | 75/333 |
| 4,917,852 | A | * | 4/1990 | Poole et al. | 264/500 |
| 5,147,448 | A | * | 9/1992 | Roberts et al. | 75/331 |
| 5,498,446 | A | | 3/1996 | Axelbaum et al. | |
| 5,514,349 | A | | 5/1996 | Parker et al. | |
| 5,609,919 | A | | 3/1997 | Yuan et al. | |
| 5,707,419 | A | | 1/1998 | Tsantrizos et al. | |
| 5,738,705 | A | * | 4/1998 | Anderson et al. | 75/332 |
| 5,788,738 | A | | 8/1998 | Pirzada et al. | |
| 5,876,794 | A | | 3/1999 | Huet | |
| 5,935,461 | A | | 8/1999 | Witherspoon et al. | |
| 6,580,051 | B1 | | 6/2003 | Peterson et al. | |
| 2003/0126948 | A1 | | 7/2003 | Yadav et al. | |

OTHER PUBLICATIONS

Liu, "Science and Engineering of Droplets."

* cited by examiner

1018 Steel Atomization

Section View

Where:

$\omega_1^2R_1$ - Containment Centripetal Acceleration
$\omega_2^2R_2$ - Secondary Centrifuge Centripetal Acceleration
$A_n$ - Normal Acceleration
$A_t$ - Tangential Acceleration Where:

$\omega_1^2 R_1$ - Containment Centripetal Acceleration ($A_n$)
$\omega_2^2 R_2$ - Secondary Centrifuge Centripetal Acceleration
$2\omega_2 v$ - Coriolis Acceleration
$A_n$ - Normal Acceleration
$A_t$ - Tangential Acceleration
$A_r$ - Resultant Acceleration i.e. $\omega_1^2 R_1 + \omega_2^2 R_2 + 2\omega_2 v$
v - Melt Radial Velocity

ATOMIZATION TECHNIQUE FOR PRODUCING FINE PARTICLES

FIELD OF THE INVENTION

The present invention relates to a novel process for atomizing a liquid material or a mixture of liquid materials. More specifically, the present invention advances the art by utilizing the inertial forces created in an elevated acceleration environment to further miniaturize and enhance the characteristics of particles resulting from atomization. The key to this invention is to subject a melt material to an elevated acceleration and pass a fluid over the surface of the melt. The purpose of the elevated acceleration is to elevate the relative importance of gravitational forces in the melt thus miniaturizing any gravity influenced disturbance. This elevated acceleration environment leads to miniaturization of gravitationally dependent phenomena thus leading to smaller particle creation. The purpose of the atomizing fluid is to impart kinetic energy onto the melt thereby causing disturbances and to act as a heat transfer media to cool the particles.

In other words, the present invention not only utilizes bursting bubbles, surface waves, and splashes to create fine particles by purposely introducing gas flow on the liquid material(s) to be atomized but further enhances the process by facilitating that these material(s) are simultaneously at elevated acceleration. The novel aspects of the present invention significantly enhance the physical characteristics of the resulting particles, by allowing smaller particles to be produced, by cooling the particles more rapidly and by reducing contamination threats by avoiding physical contact between the material(s) being atomized and any refractive materials.

BACKGROUND OF THE INVENTION

Droplets are encountered in nature and a wide range of science and engineering applications. Naturally occurring droplets are found in dew, fog, rainbows, clouds/cumuli, rains, waterfall mists, and ocean sprays. Showerheads, garden hoses, hair sprays, paint sprays, and many other commonly accepted devices are used to facilitate a dispersion of droplets into the surrounding air. Additionally, a variety of important industrial processes involve discrete droplets, such as spray combustion, spray drying, spray cooling, spray atomization, spray deposition, thermal spray, spray cleaning/surface treatment, spray inhalation, aerosol (mist) spray, crop spray, paint spray, etc. The related industrial areas span automotive, aerospace, metallurgy, materials, chemicals, pharmaceuticals, paper, food processing, agriculture, meteorology, power generation. Not withstanding the natural aspects of droplets, it is the increased desire for finer or smaller particles in industrial applications that led to the present invention's improvement in the atomization process. (Science and Engineering of Droplets by Huimin Liu.)

In addition to the general discussion of the state of the art presented herein, attention is also directed to Science and Engineering of Droplets, Fundamentals and Applications, by Huimin Liu (ISBN 0-8155-1436-0). In this book Ms. Liu presents a good overview of some of the various techniques currently used to atomize liquids.

At the present time, various atomization processes manufacture most metal powders. The principle underlying these processes is often the same: a liquid metal placed in a distributor is forced through a nozzle to obtain a thin jet which is dispersed in the form of particles by the rapid motion of a gas or of a stream of liquid.

Three classes of atomization processes can be distinguished. According to a first class, the liquid metal, in most cases, is atomized at the time of the casting. In a particular case of the process, the disintegration of the liquid into particles is produced by the mechanical action of a rotating disc, but, in general, the atomization is produced by air, gas, water, and under vacuum by bursting of the liquid due to a great pressure difference and dissolved gases coming out of liquid solution. An improvement to this scheme is pulsed plasma atomization where a plasma shock tube is used to impart very high impulse loads on the descending melt leading to finer particles. (U.S. Pat. No. 5,935,461) Another recent development is to force molten material through small holes as in Pulsed Atomization. (U.S. Pat. No. 5,609,919) Spraying of solid particles has also been mentioned, but so far has been limited to the agglomeration of, or the introduction with, the dispersible liquid material.

Another class of processes has been developed a little more recently. This is atomization by centrifugal force which is applied according to two variants: either the melting electrode forms the starting material for obtaining the particles, or the distributor containing the liquid is subjected to a rotation which causes the ejection of the liquid in the form of drops against the cooled walls of a plant, thus enabling a powder to be recovered. In each of these cases atomization occurs when the centrifugal force of the particle exceeds the surface tension retaining force.

Finally, a last class consists of processes employing ultrasonic technology, a vibrating electrode, and cooled rolls that rotate. (U.S. Pat. No. 5,876,794)

There are some other "laboratory stage" methods of atomization. Papers have been presented (2002 World Congress on Powder Metallurgy and Particulate Materials June 2002) that included descriptions of Impulse Atomization, and Plasma Atomization. Exploding wire atomization is in commercial use at Argonide Nanomaterials Corp. Flame synthesis is used commercially by AP Materials (U.S. Pat. No. 5,498,446).

Impulse atomization is a technique where the melt is forced through holes in ceramic material. The size of the resulting powder is proportional to the size of the holes. It is believed that the smallest powders this technique could ever produce would be approximately 20 μm. Plasma atomization is a simple process where a sacrificial wire is subjected to the blast of a plasma jet (U.S. Pat. No. 5,707,419). This high temperature blast is strips off molten material that becomes powder.

There are also four patents and one published patent application that relate to this area of endeavor that may warrant attention relative to the present invention. While only the first is strictly an atomizer i.e. the material is melted, converted to smaller units then these smaller units are solidified, all relate to the manufacture of fine metal powders. The first (U.S. Pat. No. 5,935,461) outlines a technique where a pulsed plasma jet is used to blast a stream of molten material in a manner similar to gas atomization.

The next three involve techniques where the material(s) to be subdivided into particles are vaporized then condensed. The second, (U.S. Pat. No. 5,788,738) is such a device. The third, (U.S. Pat. No. 5,514,349) is a variation on that approach. The fourth, (U.S. Pat. No. 6,580,051) uses an electro thermal gun to improve the exploding wire technique. Lastly, U.S. patent application US20030126948A1 discloses a means of producing high purity fine metals, metal oxides, nitrides, borides, carbides and carbonitride fine powders using a high temperature chemical reaction/precipitation technique.

There are other methods of producing metal powders that use centripetal acceleration to enhance the process. These methods are outlined in Powder Metallurgy Science, German (ISBN 1-878954-42-3). The disk and cup methods require the liquid to be forced radially outward thus thinning the melt prior to release and atomization. The mesh and rotating electrode methods use centripetal acceleration to pull drops away from the parent material. Dr. Yunzhong Liu—National Institute for Materials Science (Japan) presented a paper at the 2002 World Congress on Powder Metallurgy & Particulate Materials conference where he described a hybrid gas and centrifugal atomization system.

The means to manufacture fine metal powders can be broken into two broad categories. First there are those methods that vaporize the material or some compound of the material then precipitate the material out of the vapor or gaseous form through either a chemical reaction or heat removal.

Those techniques of the second means spread a molten material into thin liquid layer until instabilities force the layer to disintegrate into smaller units. Due to surface tension these units quickly form spheres. Heat is removed resulting in powder. The invention we're attempting to protect falls into this second category.

Before the technical discussion of the present invention commences, it may be valuable to specifically identify at least one of the particular industrial applications that will be significantly benefited by the development of the present invention. Metal Injection Molding (MIM) is a manufacturing technique where a slurry of fine powdered metal and binder are forced into a metal cavity in a manner very similar to plastic injection molding. The slurry hardens in the mold and the hardened material (called a compact) is released. The binding agent is then removed from the metal by one of several different means. The remaining metal is placed in a furnace and sintered.

During sintering the compact shrinks as the individual powder particles join to one another ultimately reaching full density. The industry standard is to use powder of approximately 15 μm diameter for this application. This process can be improved by using smaller diameter particles. Smaller particles sinter more readily, which would enable the duration and/or the sintering temperature to be reduced. Smaller particles also reduce the surface roughness of the finished part.

The current commercial techniques for atomizing metals i.e. gas, water and centrifugal atomization, are, for the most part, mature technologies that are impractical techniques to produce the still smaller powders and particles needed to advance the industry. Something new is needed.

Diminishing the size of atomized metal powder serves two purposes: it permits more rapid and/or lower temperature sintering and it allows heat to be extracted from the atomized material more rapidly. These two effects are interrelated.

While the increased surface energy inherent to a smaller particle is not a trivial contribution to technology, the large contribution this invention offers is the ability to cool the particles quickly. High cooling rates lead to reduced particulate microstructure grain size and in extreme situations amorphous microstructures. Rapidly solidified (small grain size) alloys can lead to improved magnetic, electrical, mechanical, wear and corrosion properties (Powder Metallurgy Science—German ISBN 1-878954-42-3). Smaller crystalline grains lead to a greater portion of the solidified material being grain boundaries that enables elevated diffusion during sintering. Operationally, the elevated diffusion allows decreased sintering temperature and/or duration.

While the known atomization processes of the state of the art exhibit features that are not insignificant, such as, obtaining very dense and homogeneous particles with a good purity and an efficient control of the composition, in most cases, they cannot make very small particles, are uneconomical in doing so, or are incapable of making alloys.

The present invention overcomes the shortcomings of the existing technologies by introducing a novel and non-obvious process for manufacturing particles that are significantly smaller (finer) and cooled more quickly than currently possible through known atomization techniques. Without question, the availability of smaller finer particles through the atomization techniques of the present invention will allow noteworthy advancements in a variety of manufacturing environments, such as in MIM.

As stated earlier, the present invention relates to a novel process for atomizing a dispersible liquid material or a mixture of dispersible liquid materials. More specifically, the present invention utilizes bursting bubbles, surface waves, and splashes to create fine particles by purposely introducing gas flow on the liquid material(s) to be atomized while these material(s) are simultaneously at an elevated acceleration: thereby significantly enhancing the physical characteristics of the resulting particles, i.e. miniaturize, while reducing contamination threats by avoiding physical contact between the material(s) being atomized and any refractive materials. In other words, the present invention advances the art by utilizing the inertial forces of an elevated acceleration environment to miniaturize the process of atomization seen in nature.

SUMMARY OF THE INVENTION

In accordance with the present invention, the limitations of the prior art are avoided by introducing an atomizer system that utilizes an elevated acceleration environment to facilitate the creation of particulates with enhanced properties relative to those presently possible. More specifically, the atomizer system and atomization method of the present invention comprises a unit that accelerates the environment of the melt material being atomized such that the gravitational forces experienced by the melt material are elevated relative to Earth's standard gravitational force. The present invention additionally incorporates atomizing fluid that flows across an exposed surface of the melt material facilitating the establishment of liquid droplets that aerosolize and create fine particulates.

The present invention is also directed at an associated system and method for atomizing a material comprising the steps of accelerating the environment of the material to be atomized such that the gravitational forces experienced by the material are elevated relative to Earth's standard gravitational force; and flowing an atomizing fluid across an exposed surface of the material facilitating the establishment of liquid droplets which aerosolize and create fine particulates.

BRIEF DESCRIPTION OF THE DRAWINGS

The various objects, advantages, and novel features of this invention will be more readily apparent from the following detailed description when read in conjunction with the enclosed drawings and appendices, in which.

DETAILED DESCRIPTION OF THE PREFERRED EMBODIMENT

Figure 1:
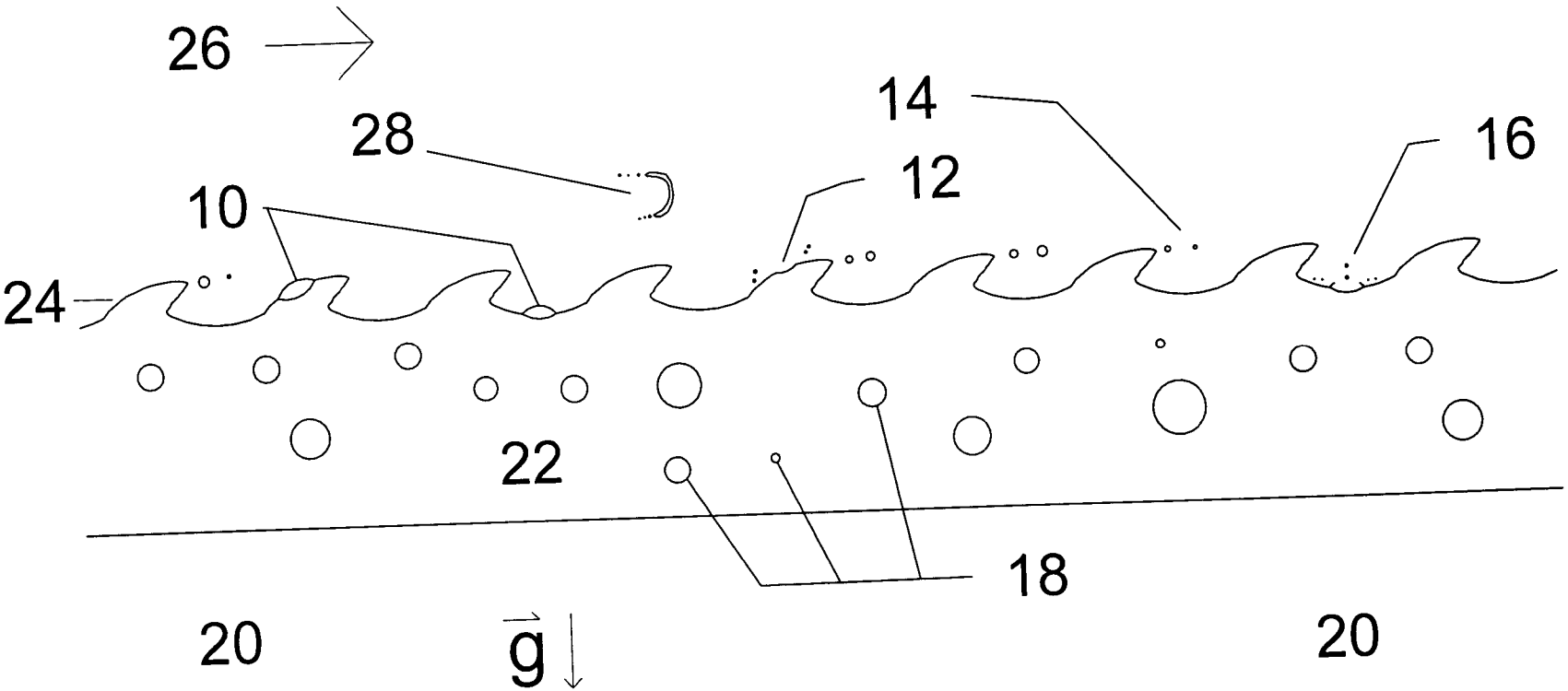
FIG. 1 depicts the formation process of various forms of drops established via moving liquids.

In it's most general terms, the atomization technique of the present invention is unique because it uses elevated acceleration to raise melt gravitational forces. The gravitational force increase resulting from the elevated acceleration introduces the same internal stress in a smaller object as in a larger one at normal gravitation. This is the premise used in geotechnical centrifuge modeling. Geotechnical centrifuge modeling is a scale modeling technique often used to simulate soil/structure interactions. It allows a scale model to be subjected to the same levels of stress as the full size item. In other words, a smaller object at elevated acceleration will behave similarly to a larger object at Earth's unaltered and naturally occurring gravitational acceleration. This is very important and is the reason why the method of atomization described and claimed herein is a significant improvement over every other method of atomization currently used.

In other words, the present invention advances the art by utilizing the inertial forces created in an elevated acceleration environment to further miniaturize and enhance the particles resulting from atomization. The key to this invention is to subject a melt material to an elevated acceleration and pass a fluid over the surface of the melt. The purpose of the elevated acceleration is to elevate the relative importance of gravitational forces in the melt thus miniaturizing any gravity influenced disturbance. The purpose of the atomizing fluid is fourfold: 1.) to impart kinetic energy onto the melt thereby causing disturbances, 2.) to act as a heat source or sink depending upon atomizing configuration, 3.) in certain circumstances, to act as a media for chemical reaction, and 4) to provide an aerosolization media.

Before specifically addressing the exact procedures of the present invention, it may be beneficial to set forth a little more technical foundation. Acceleration is the genius in Newton's second law and his law of gravitation. In general, the law of gravitation quantifies how masses are attracted to one another. However, acceleration can be created in ways other than Earth's natural pull. Acceleration also occurs in a rotating system as centripetal acceleration.

The intention of placing the material at elevated acceleration is to miniaturize the dynamics of the liquid (waves, bubbles and splashes) prior to atomization, resulting in smaller atomized particles. This is accomplished by making gravitational forces larger relative to surface tension, viscous, atomizing fluid dynamic, and other inertial forces than they would have been the case when subject only to Earth's gravitational acceleration or in free fall.

From a practical standpoint, a preferred embodiment of the present invention places liquid material desired to be atomized adjacent the inside surface of a cylinder. Next, the cylinder and selected material are rotated about an axis subjecting the material to higher acceleration thereby elevating the selected material's gravitational forces. Fluid is passed across the surface of the melt causing aerodynamic loading. Aerodynamic loading be it shear stress or turbulent eddies create disturbances on the liquid surface. These surface disturbances result in "whitecaps", breakers, wave pinching and motion of the melt that entrap atomizing fluid/gas resulting in the formation of very small drops when the entrapped fluid bubble bursts on the melt surface. Additional abet larger drops—spume drops—are formed directly in the aft portion of the wave crests. All droplets regardless of generation mechanism may 1) aerosolize, 2)

succumb to secondary atomization, or 3) impact the melt depending upon launch and environmental conditions.

There are numerous commonly accepted methods by which the water droplets are atomized in nature. The atomization mechanisms shown in FIG. 1 include: bursting bubbles 10, splashes 12, spume drops 14 from wave crests, film drops and jet drops 16 from bubbles 18. Under extreme environmental conditions some atomized droplets may subsequently shatter into smaller droplets from secondary atomization 28.

Furthermore, FIG. 1 depicts a variety of these drop formation techniques from an operational standpoint. A support unit 20 physically contains a melt material 22 such that an upper surface 24 of the melt material 22 may be exposed to an atomizing fluid 26. As the atomizing fluid 26 passes across the surface 24 of the melt material 22, bubbles 18 contained within the melt material 22 migrate toward and ultimately burst through the surface and form drops of the specific types described above.

Figure 2:
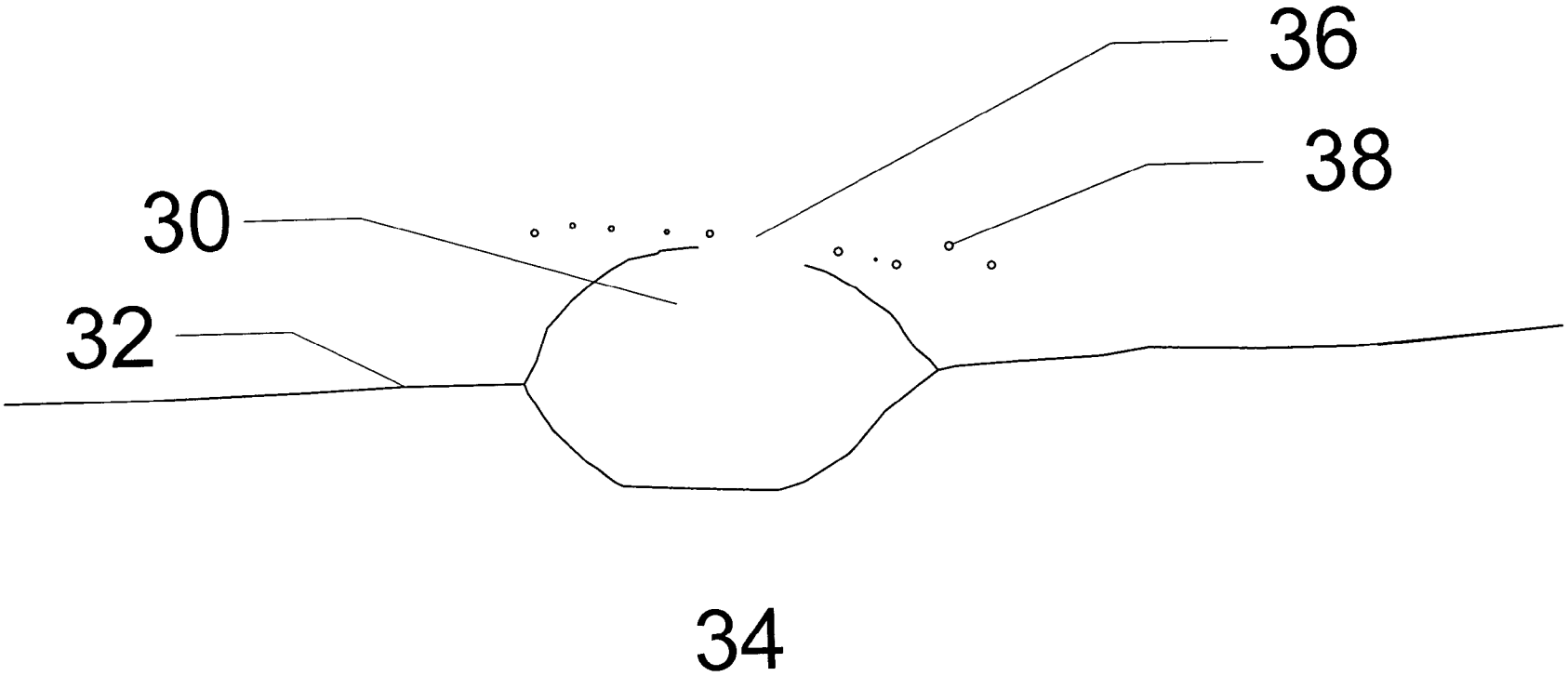
FIG. 2 sets forth a more detailed view regarding the creation and evolution of film drops.

FIG. 2 illustrates general drop formation by isolating in on a single bubble. As a bubble 30 reaches a liquid surface 32 the liquid 34 thins and ultimately ruptures. The material from the rupturing surface 36 breaks into smaller particles some of which aerosolize while others impact the liquid. Drops formed in this manner are called film drops 38.

Figure 3:
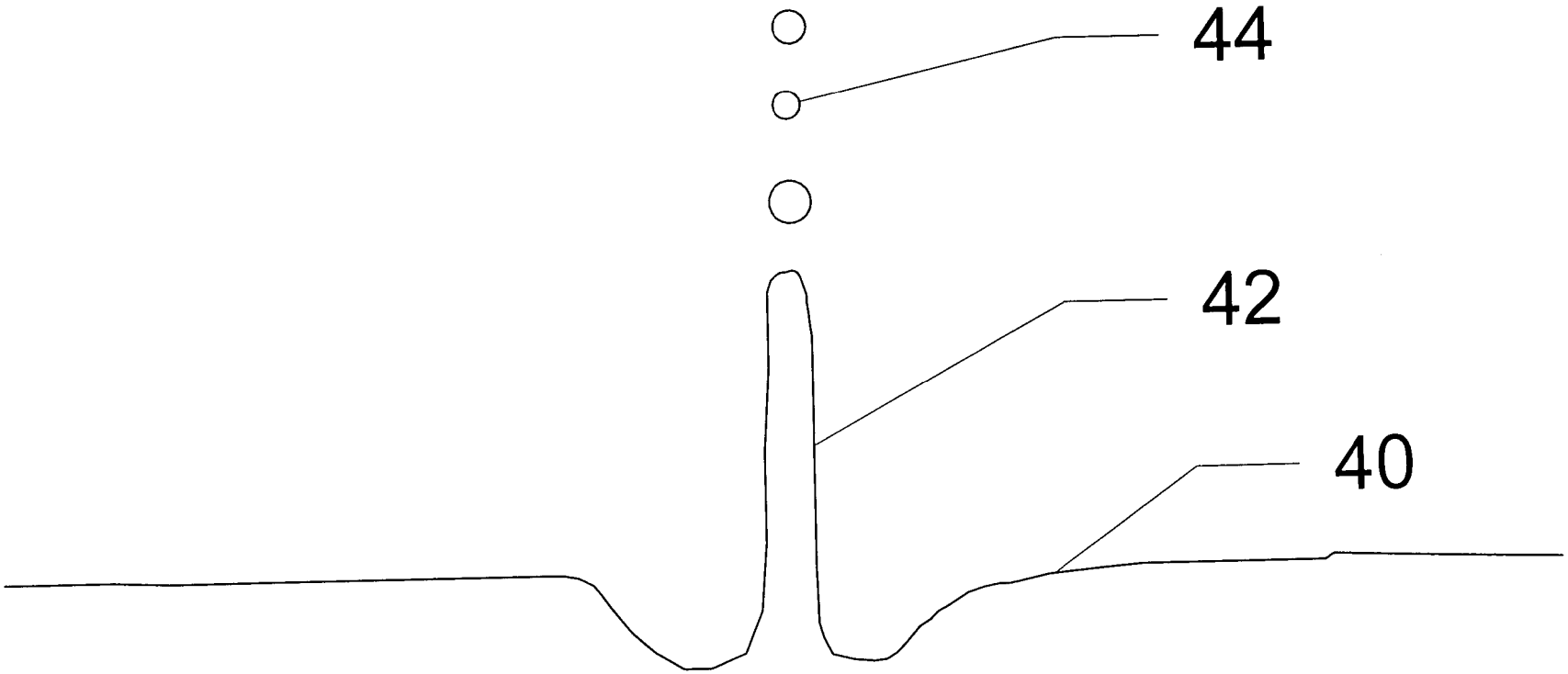
FIG. 3 sets forth a more detailed view regarding the creation and evolution of jet drops.

Referring now to FIG. 3, once a bubble has ruptured, the ascending column of liquid beneath what was the bubble has sufficient kinetic energy to rise above the nominal liquid level 40 in the form of a small diameter jet 42. This jet 42 breaks into smaller particles called jet drops 44.

Figure 4:
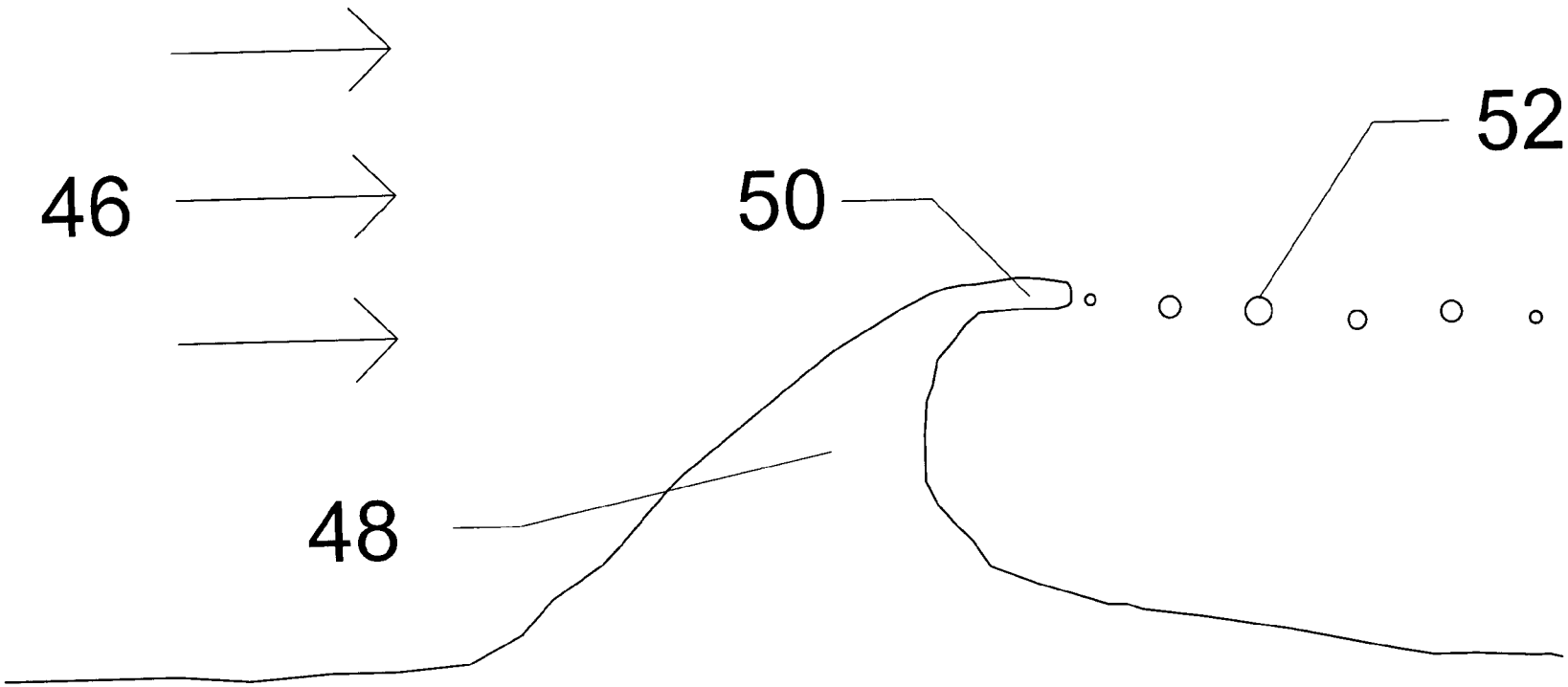
FIG. 4 sets forth a more detailed view regarding the creation and evolution of spume drops.

As shown in FIG. 4, the down flow side, as generated by the flow of atomizing fluid 46, of a wave crest 48 will deform into a narrow point 50. At this point 50 droplets of liquid are sheared off by aerodynamic loading forming spume drops 52.

Figure 5:
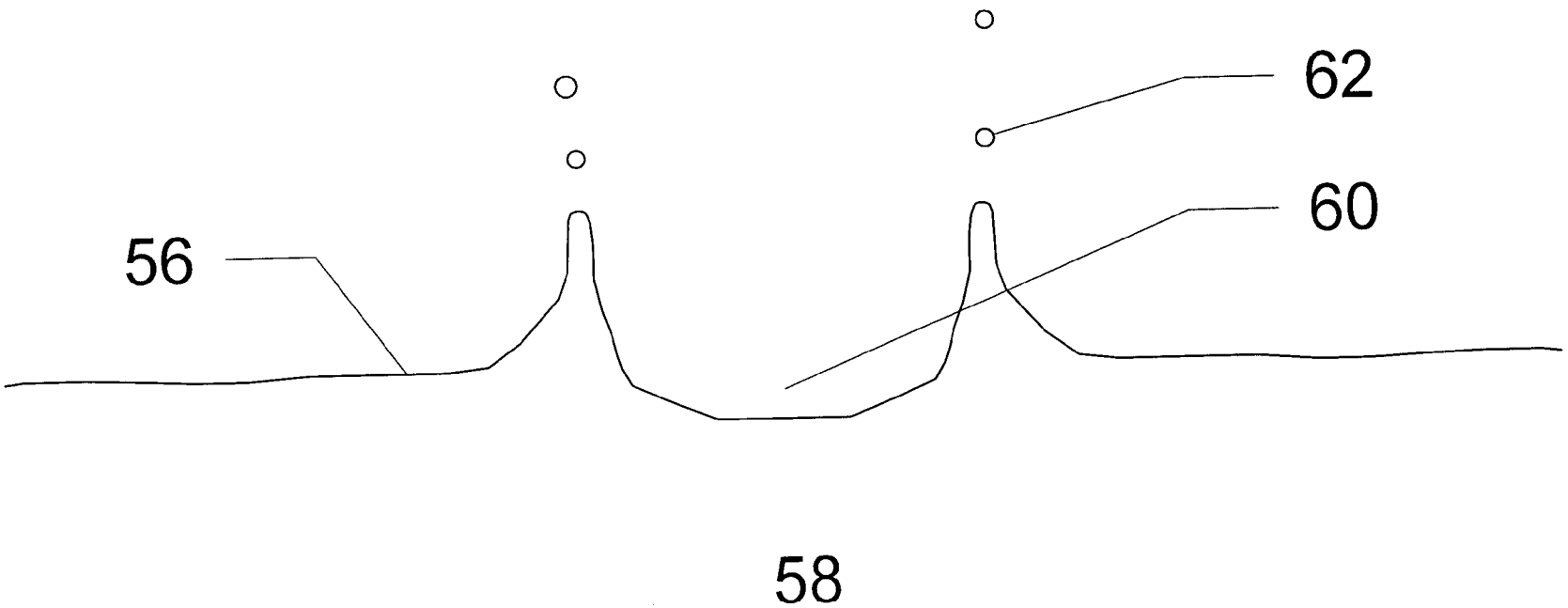
FIG. 5 depicts a section view of the formation of droplets from splash.

An additional source of droplets is splashes of material resulting from drops impacting the liquid surface, as shown in FIG. 5. A splash occurs when a particle (not shown) within the atomizing fluid impacts the surface 56 of the melt 58, causing a disturbance and creating a splash crater 60 that results in the projection of a roughly circular ring of melt into the atomizing fluid and away from the melt surface. As the ring extends into the atomizing fluid it ultimately becomes unstable, disintegrates resulting in the formation of droplets 62.

Figure 6:
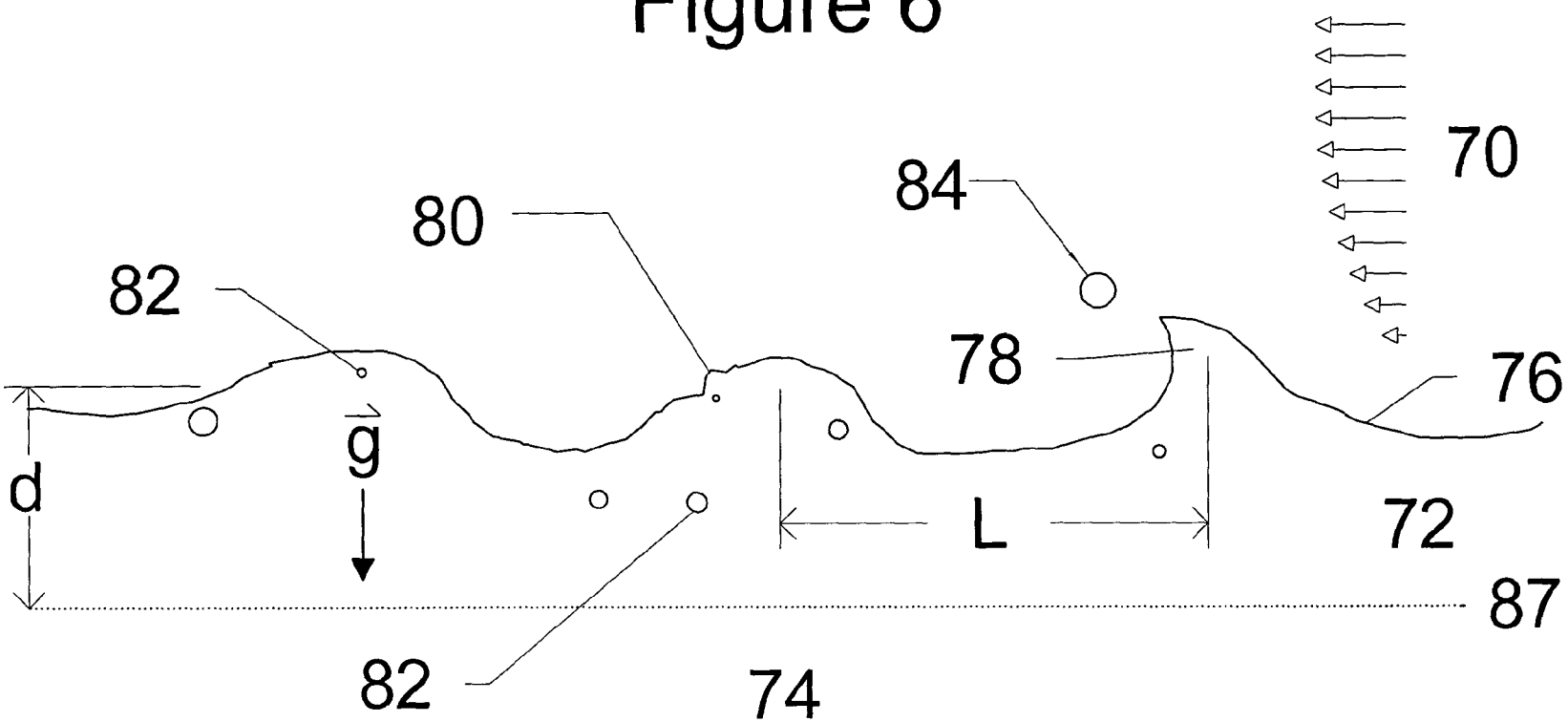
FIG. 6 generally illustrates the atomization process in an accelerated environment.

FIG. 6 graphically introduce the novel aspects of the present invention as it relates to how the drop formation techniques discussed above are significantly enhanced when the overall atomization operation occurs within an environment having elevated acceleration. The elevated acceleration results in greater gravitational forces being experienced by the melt. It is this phenomenon that the present invention applies to the commercial atomization process.

As stated above, motion, whitecaps, breakers, splashes, and wave pinching are means by which atomizing fluid can become entrapped (temporarily) in the dispersible liquid material. Once entrapped the fluid will become roughly spherical and can be characterized by its Eotvos number. The Eotvos number is the ratio of hydrostatic pressure difference divided by surface tension pressure for a bubble suspended in a liquid.

Eotvos Number$=\rho g d^2/\sigma$

Where:

d —Diameter (m)

g —Acceleration ($m/s^2$)

ρ—Density ($kg/m^3$)

σ—Surface Tension (N/m)

Bubbles at the same Eotvos number will behave similarly. Since the density and surface tension are physical properties of the dispersible liquid material, the bubble diameter must decline inversely with the square root of acceleration for similar bubble characterization. Thus at elevated acceleration a smaller bubble will behave in a manner similar to a larger one at Earth's naturally occurring acceleration.

The entrapped atomizing fluid becomes the enabling mechanism for the production of film and jet drops. FIG. 6 is presented as a graphical tool to help visualization of how atomizing fluid(s) can become entrapped in a liquid.

FIG. 6 is a cartoon depiction of the behavior of a melt when placed in the environment described heretofore. An atomizing fluid 70 passes over a melt material 72 that is supported on a base material 74. The atomizing fluid 70 imparts energy onto an outer surface 76 of the melt material 72 resulting in the creation of waves 78, whitecaps 80, and bubbles 82. The characteristics of the waves 78 include a wavelength, L, and a depth, d, of the melt material 72 and in accordance with the present invention, the relationship between the characteristics of the wave and the resulting wave frequency are affected by the centripetal acceleration. The wave frequency is governed by the familiar relationship for shallow depth wave motion:

$v=(gd/L^2)^{1/2}$

Where:

v—Frequency (Hz)

g—Acceleration ($m/s^2$)

d—Melt Depth (m)

L—Wavelength (m)

The aforementioned processes of film, jet, spume, and splash mechanisms form droplets 84.

The underlying principal of this invention is that the wavelength of liquid material, and minimum depth (dictated by the surface tension meniscus) decrease as a result of being subjected to elevated acceleration. Conversely, the buoyancy of bubbles is elevated in the same environment. This combination allows smaller amounts of liquid and bubbles at heightened acceleration to behave in a like manner to larger quantities in Earth's gravitational field.

Gas can be entrapped in the melt material 72 by the melt moving relative to the containment 74, by wave breaking, by splashing, by whitecaps, and by wave pinching (not shown). These entrapment mechanisms are well known to those knowledgeable in fluid mechanics.

The atomizing fluid velocity 70 will contain both axial—along the axis of rotation—and rotational components. It should be understood and appreciated that the angular velocity of the atomizing fluid is independent of the angular velocity of the containment. In accordance with the embodiments of the present invention, it is set at the discretion of the user. Such freedom permits some control over the extent of particulate re-entry into the melt. This is because the acceleration seen by the aerosol is independent of the containment acceleration and large particles move preferentially in a viscous medium (atomizing fluid) when subject to acceleration.

Process Flow Chart Description of the Present Invention

Figure 7A:
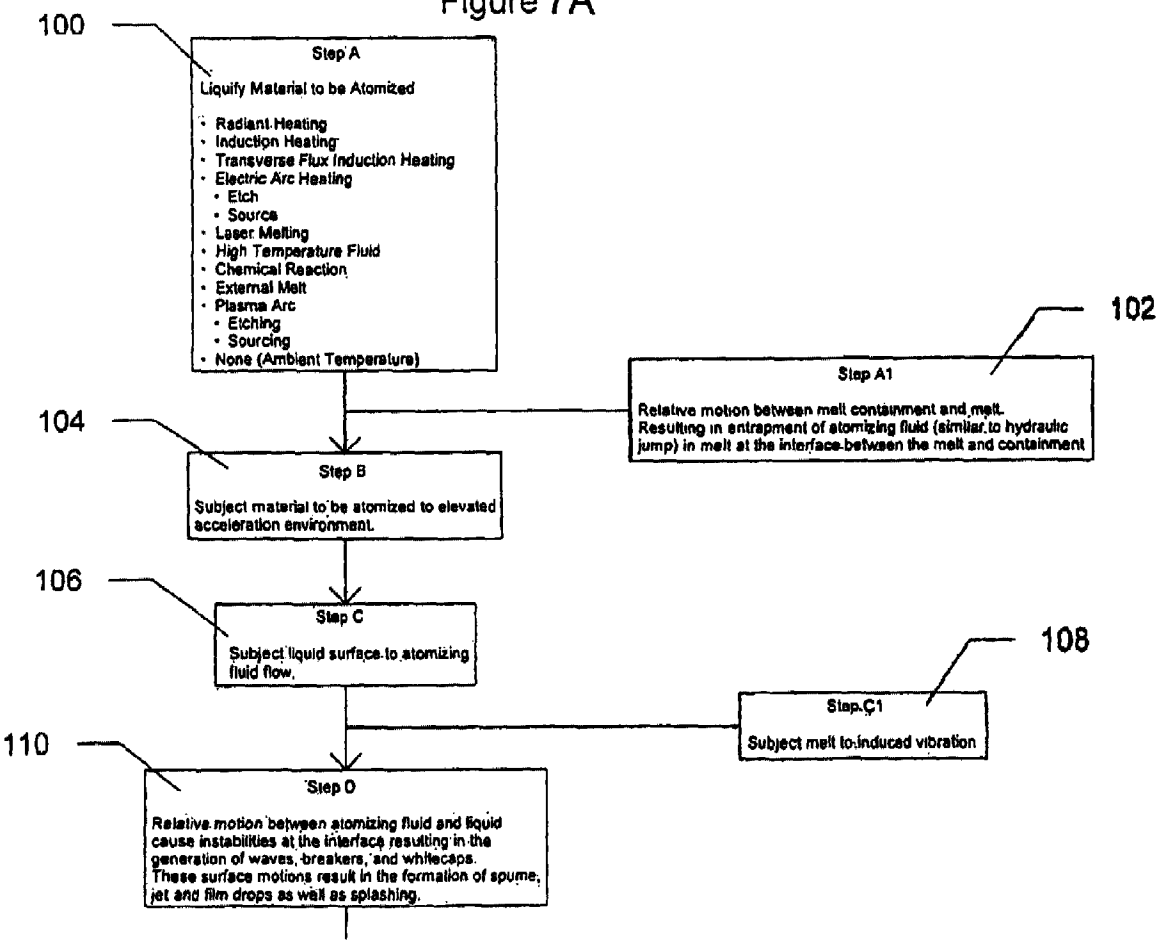
FIGS. 7*a*) and b) provide in flow chart form the various steps suitable for implementing certain embodiments of the present invention.
Figure 7B:
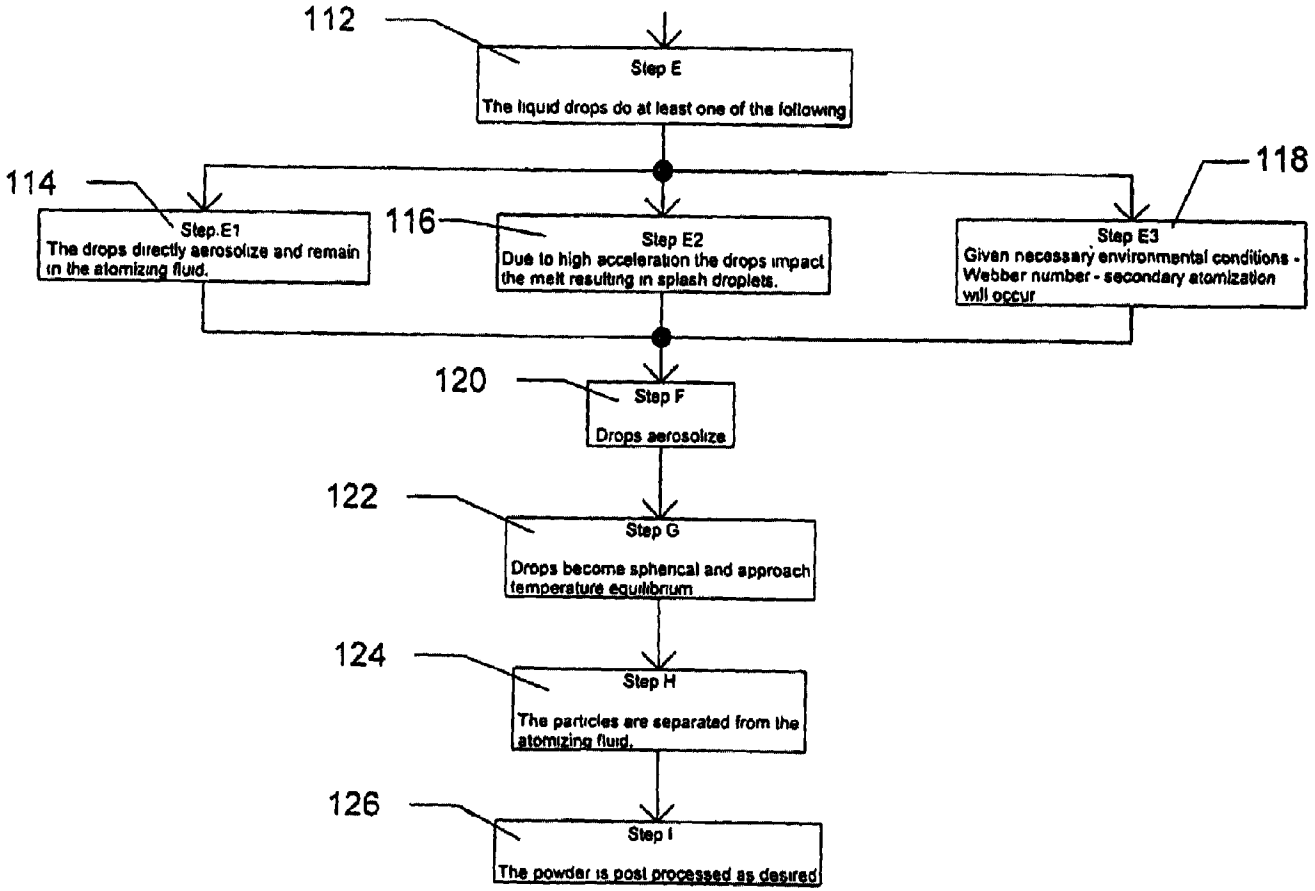

One particular manufacturing process that may be employed to facilitate the novel and beneficial results of the present invention are broken down and set forth into steps A through 1 in the flow chart illustrated herein as FIG. 7. However, before addressing the specific steps it should be noted and appreciated that the use of very broad wording in the initial descriptions of the various steps is intentional to highlight the opportunity for variations in certain aspects of the procedure without escaping the legally entitled scope of the present invention. Among other things, the atomization technique of the present invention is equally useful for atomization applications where the liquid material(s) are items other than metals. Additionally, a skilled artisan can also envision situations where it might be desirable to use a liquid as the "atomizing fluid" rather than a gas or operate at a pressure other than atmospheric.

Step A, generally depicted herein as reference numeral 100, sets forth that the actual atomization process begins with a liquid subject and outlines some of the various means by which the material(s) to be atomized can be brought to a molten state in accordance with the present invention. There are a significant number of commonly known and accepted techniques for changing the state of the material(s) to be atomized into a liquid. Some of these techniques are illustrated in FIGS. 11–16 and discussed in greater detail later within this document.

Figure 11:
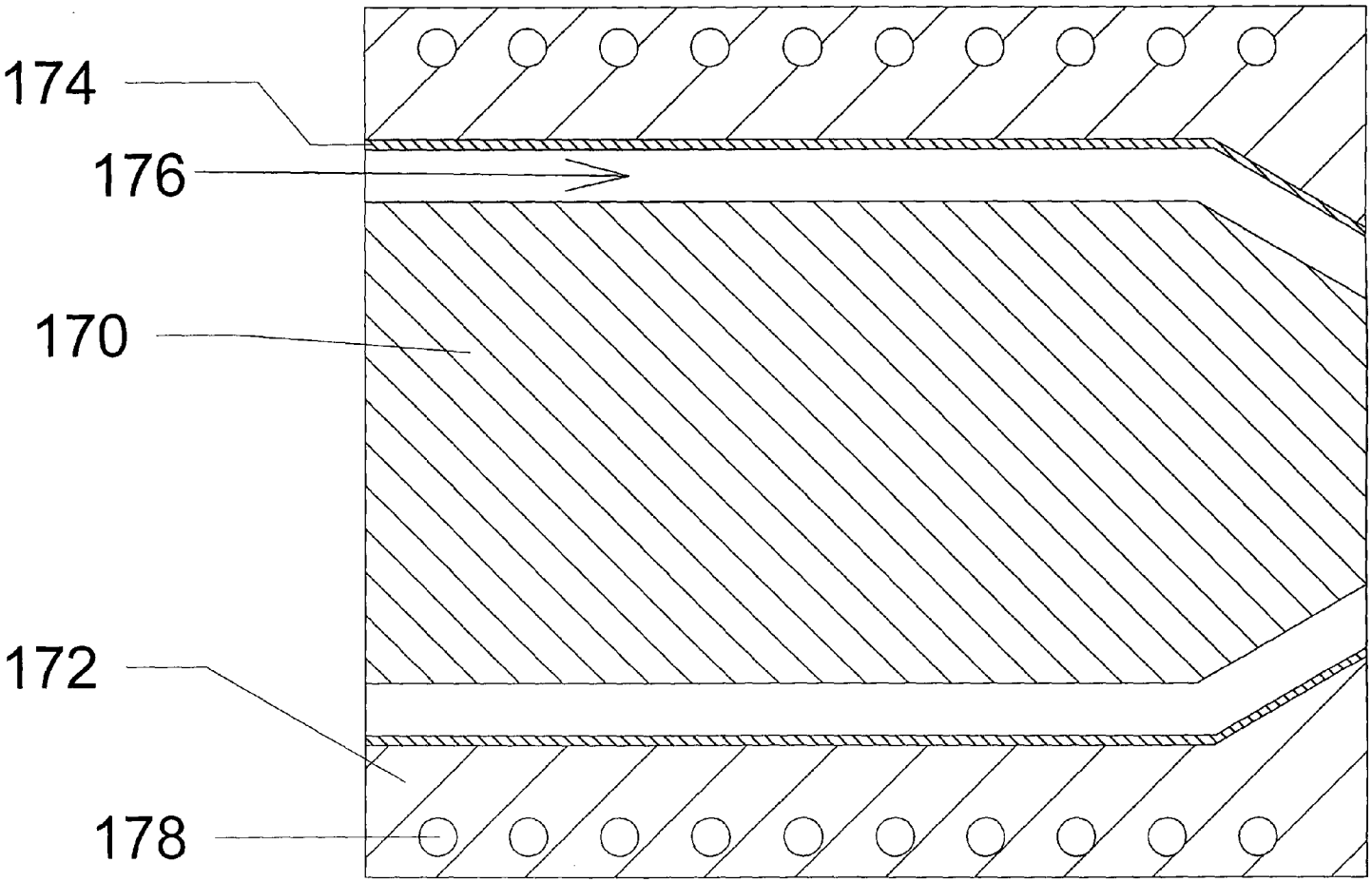
FIG. 11 illustrates the utilization of radiant heating as the liquefying technique used in accordance with the present invention.
Figure 12:
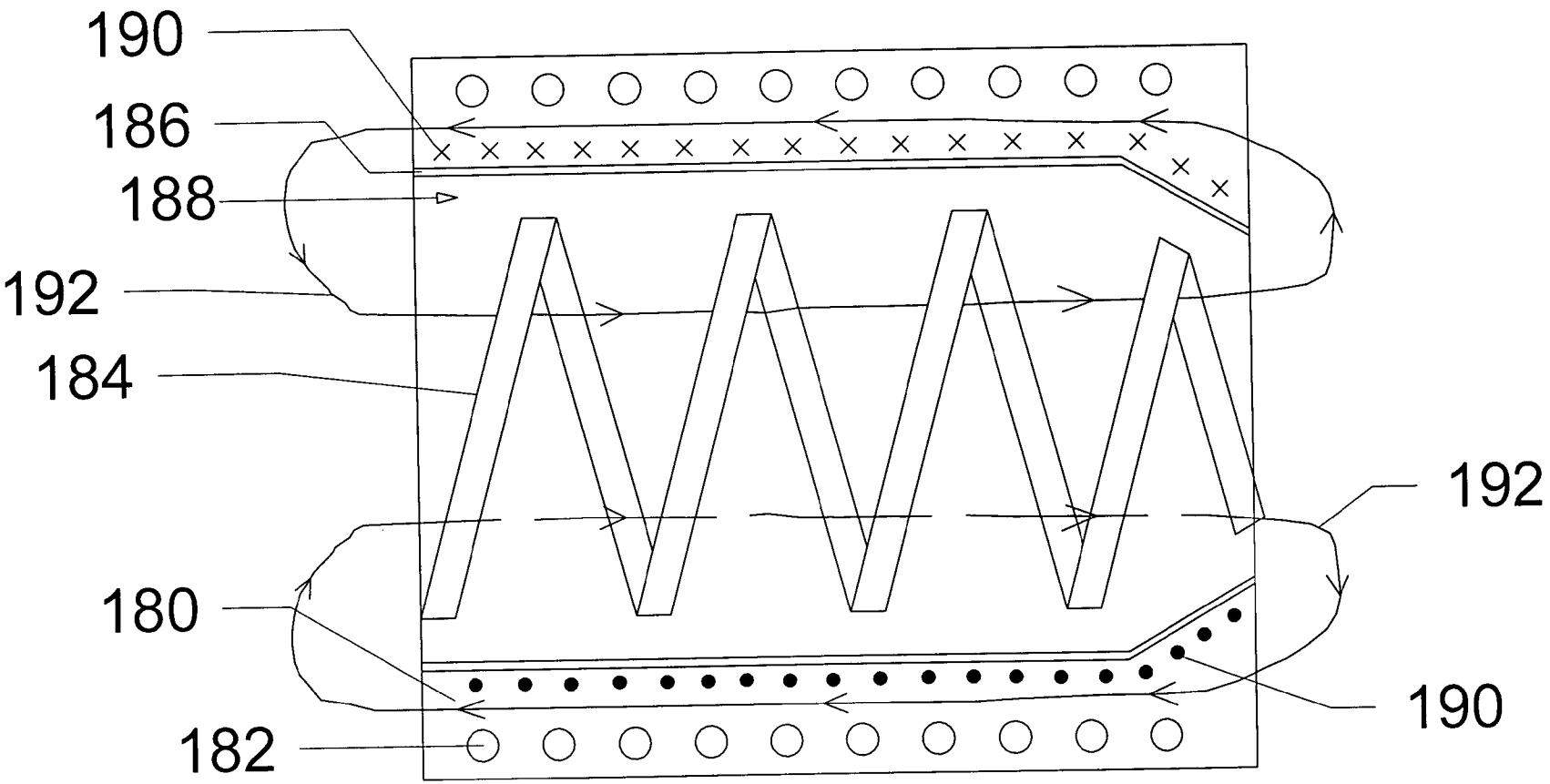
FIG. 12 illustrates the utilization of induction heating as the liquefying technique used in accordance with the present invention.
Figure 13:
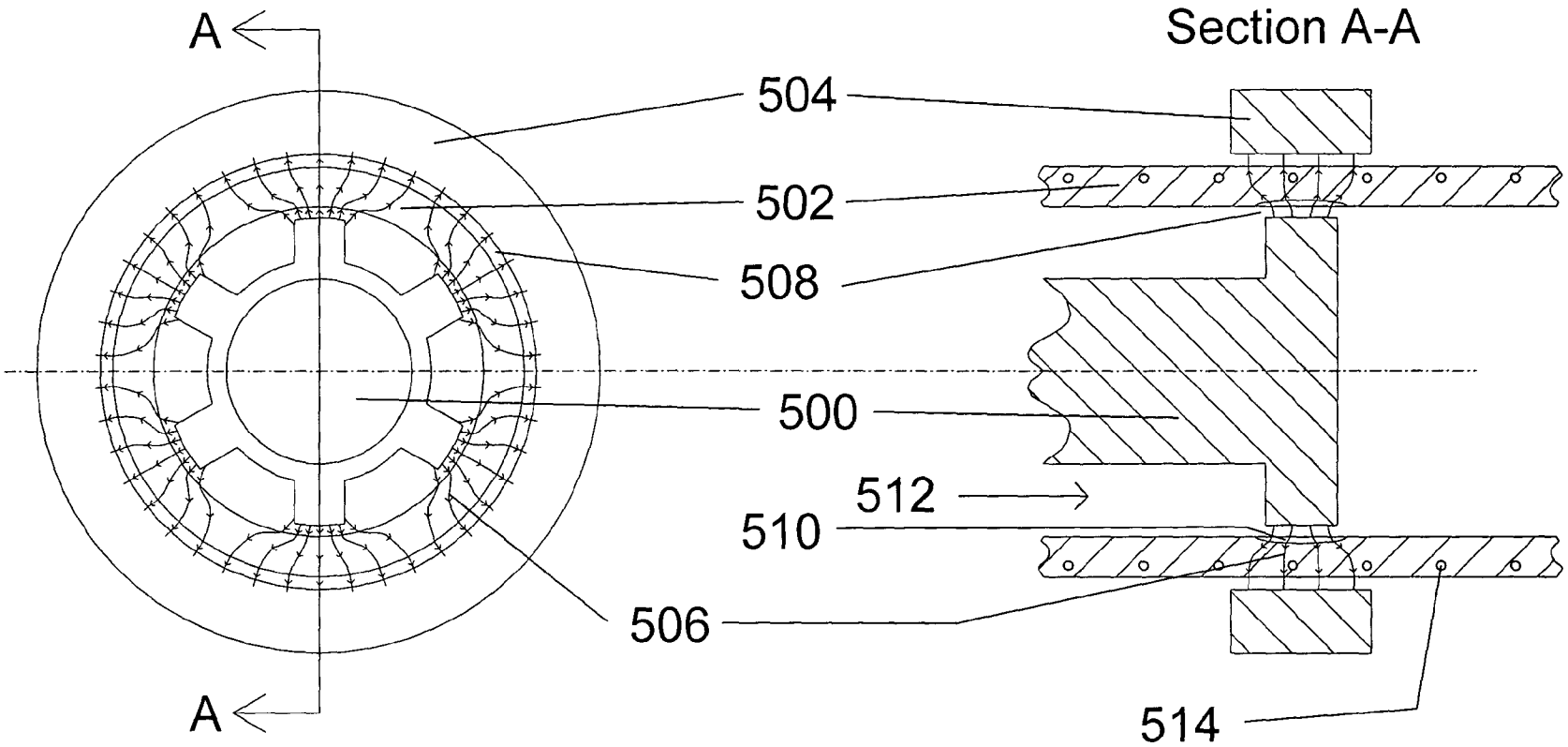
FIG. 13 illustrates the utilization of transverse flux induction heating as the liquefying technique used in accordance with the present invention.
Figure 14:
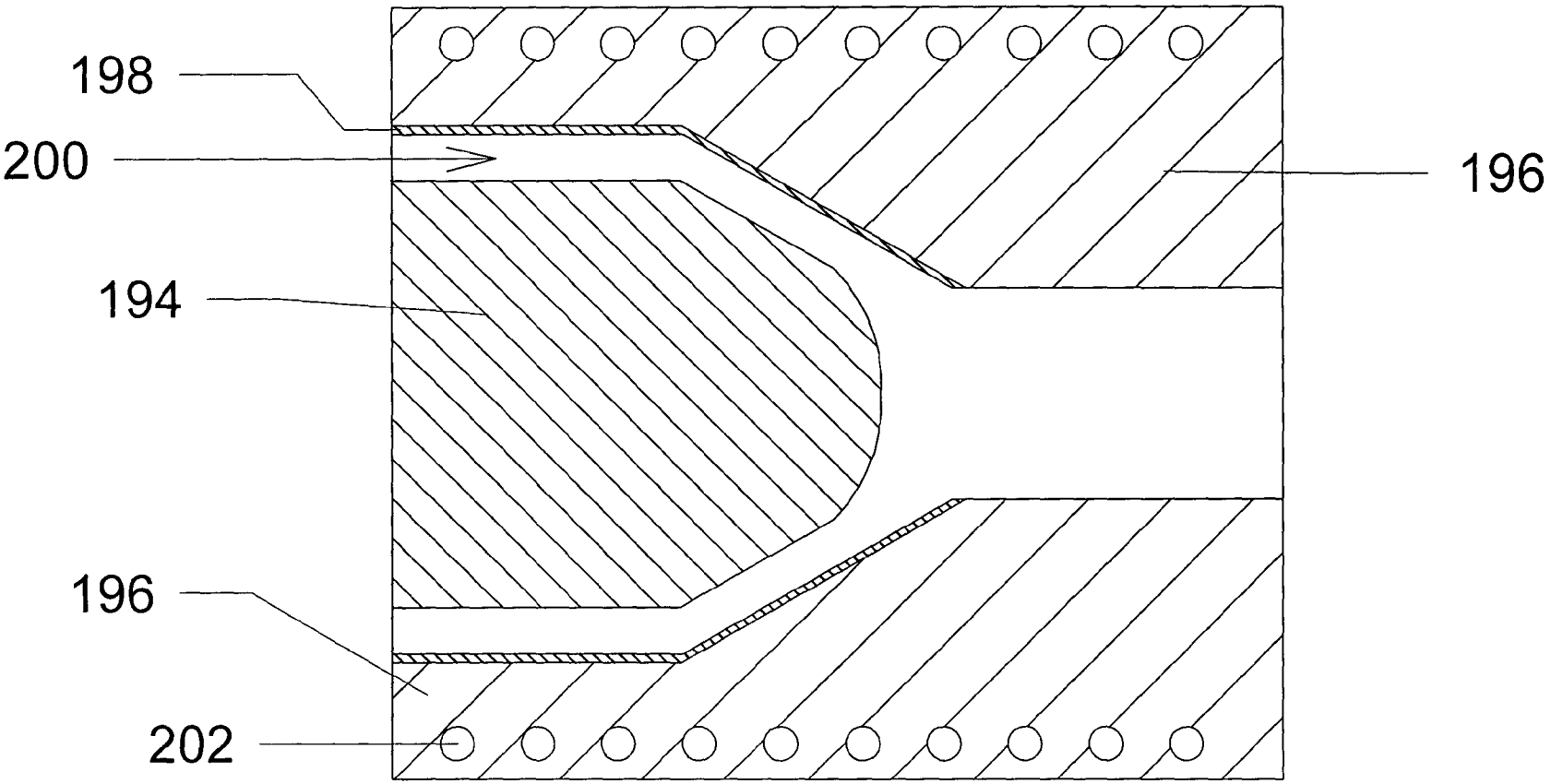
FIG. 14 illustrates the utilization of electric arc heating as the liquefying technique used in accordance with the present invention.
Figure 15:
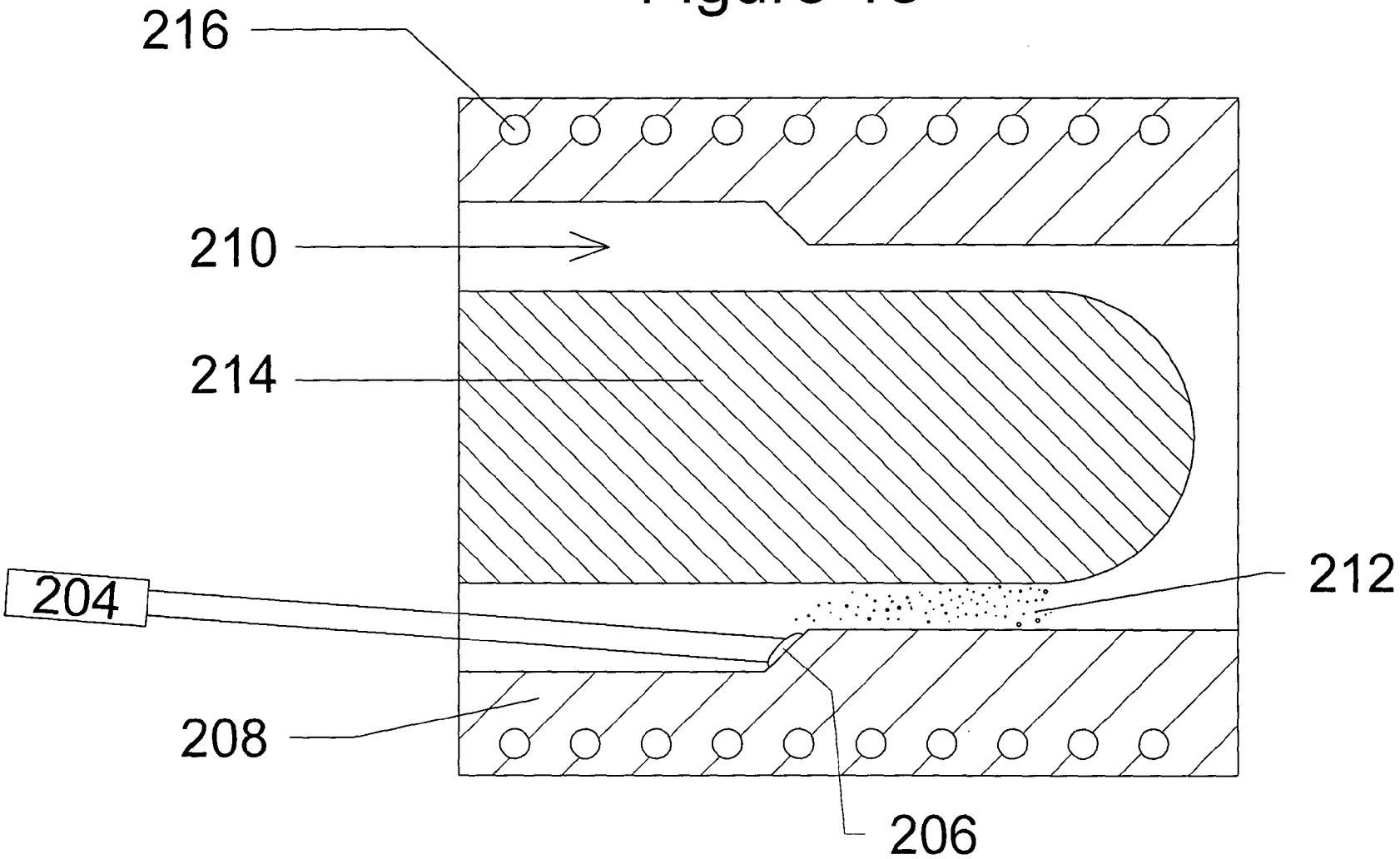
FIG. 15 illustrates the utilization of laser melt heating as the liquefying technique used in accordance with the present invention.
Figure 16:
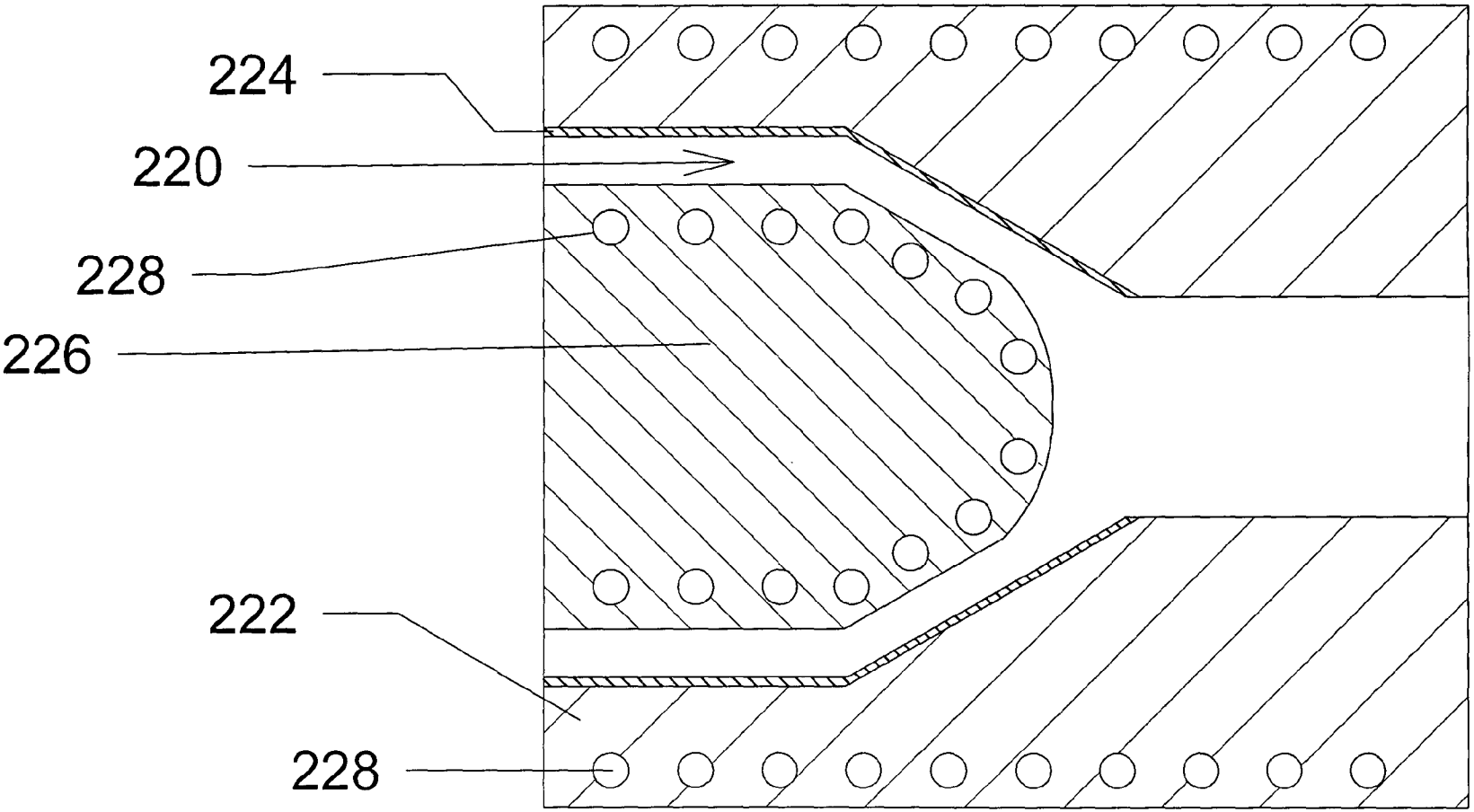
FIG. 16 illustrates the utilization of high temperature fluid heating as the liquefying technique used in accordance with the present invention.
Figure 17:
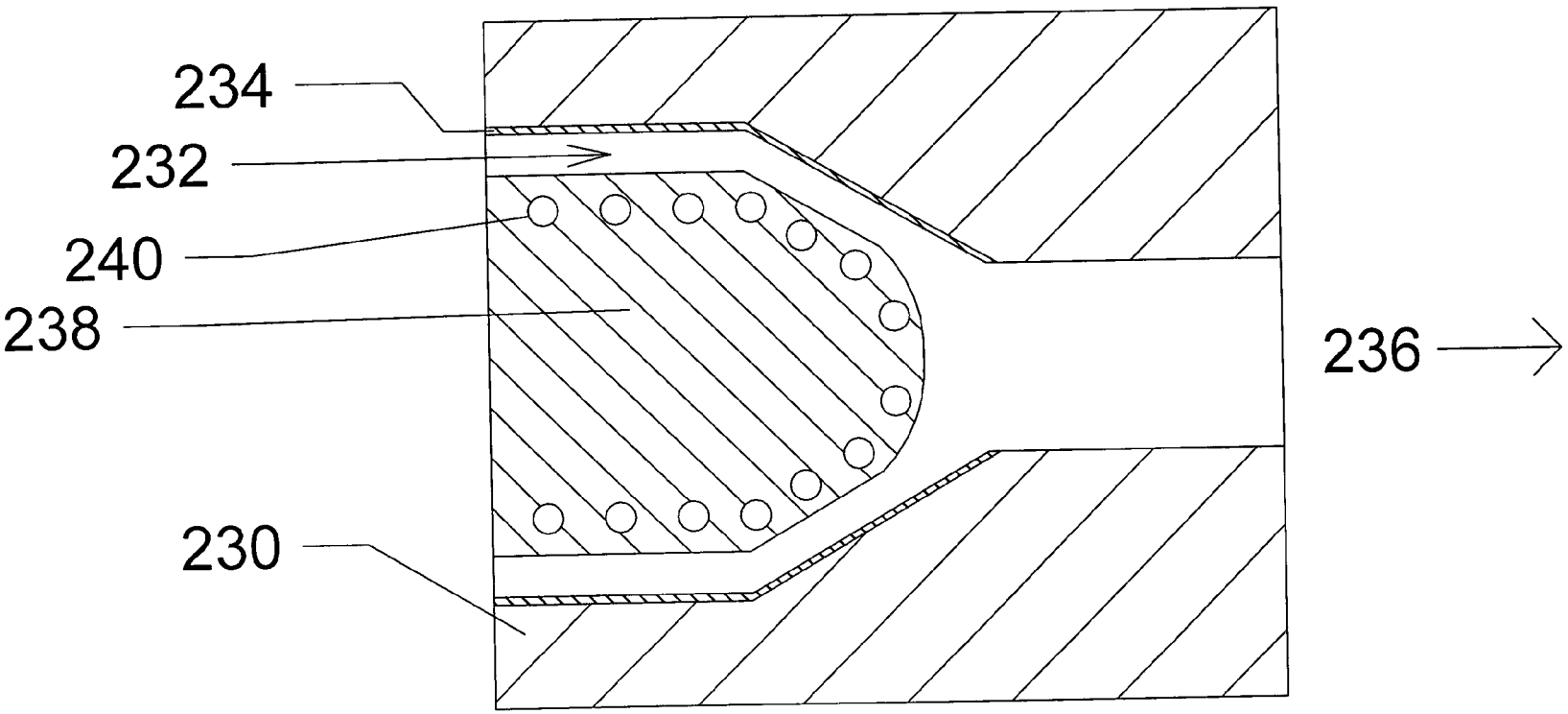
FIG. 17 illustrates the utilization of chemical reaction heating as the liquefying technique used in accordance with the present invention.
Figure 18:
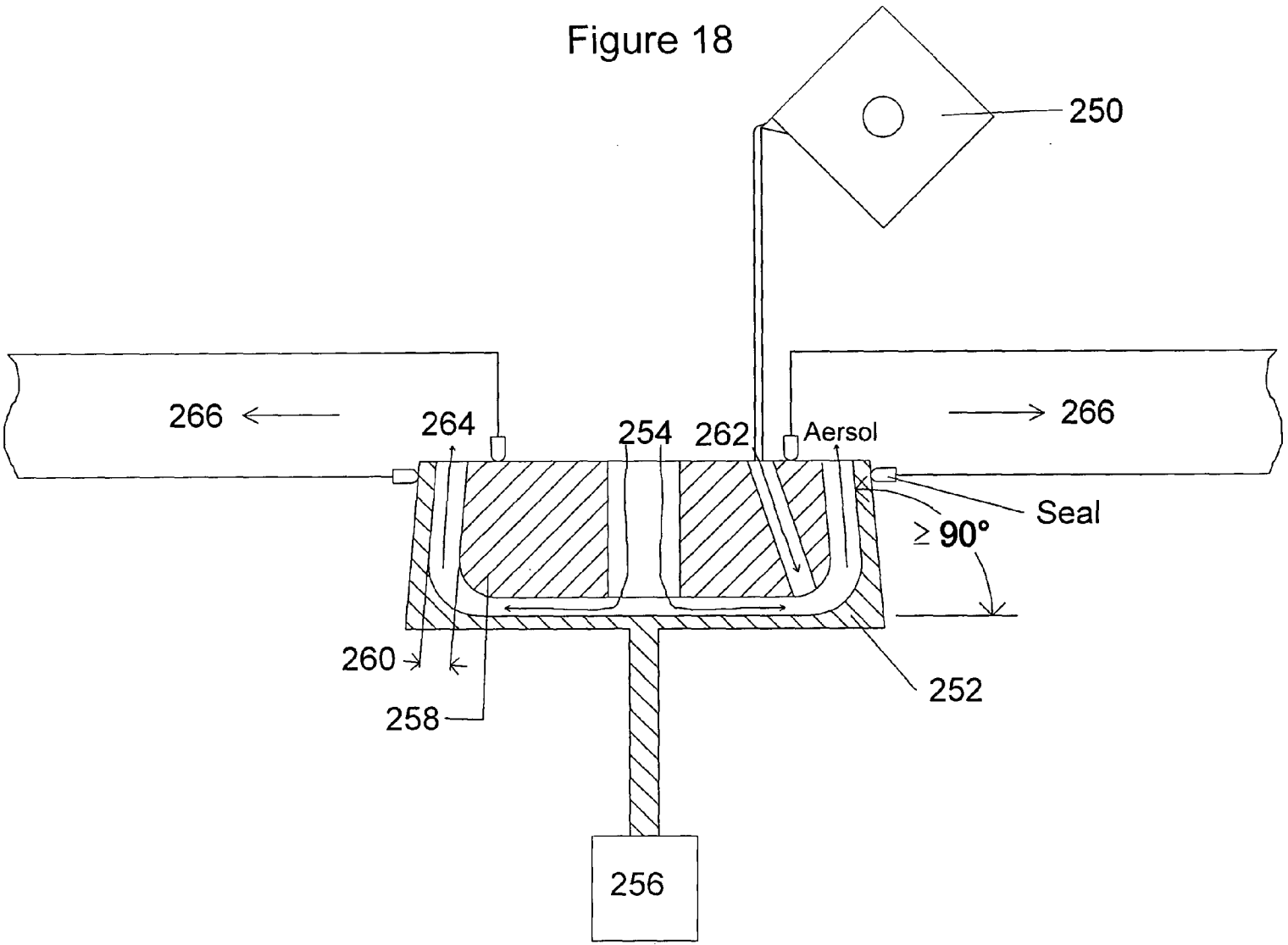
FIG. 18 illustrates the utilization of an external melt source or liquid at ambient heating as the liquefying technique used in accordance with the present invention.
Figure 19:
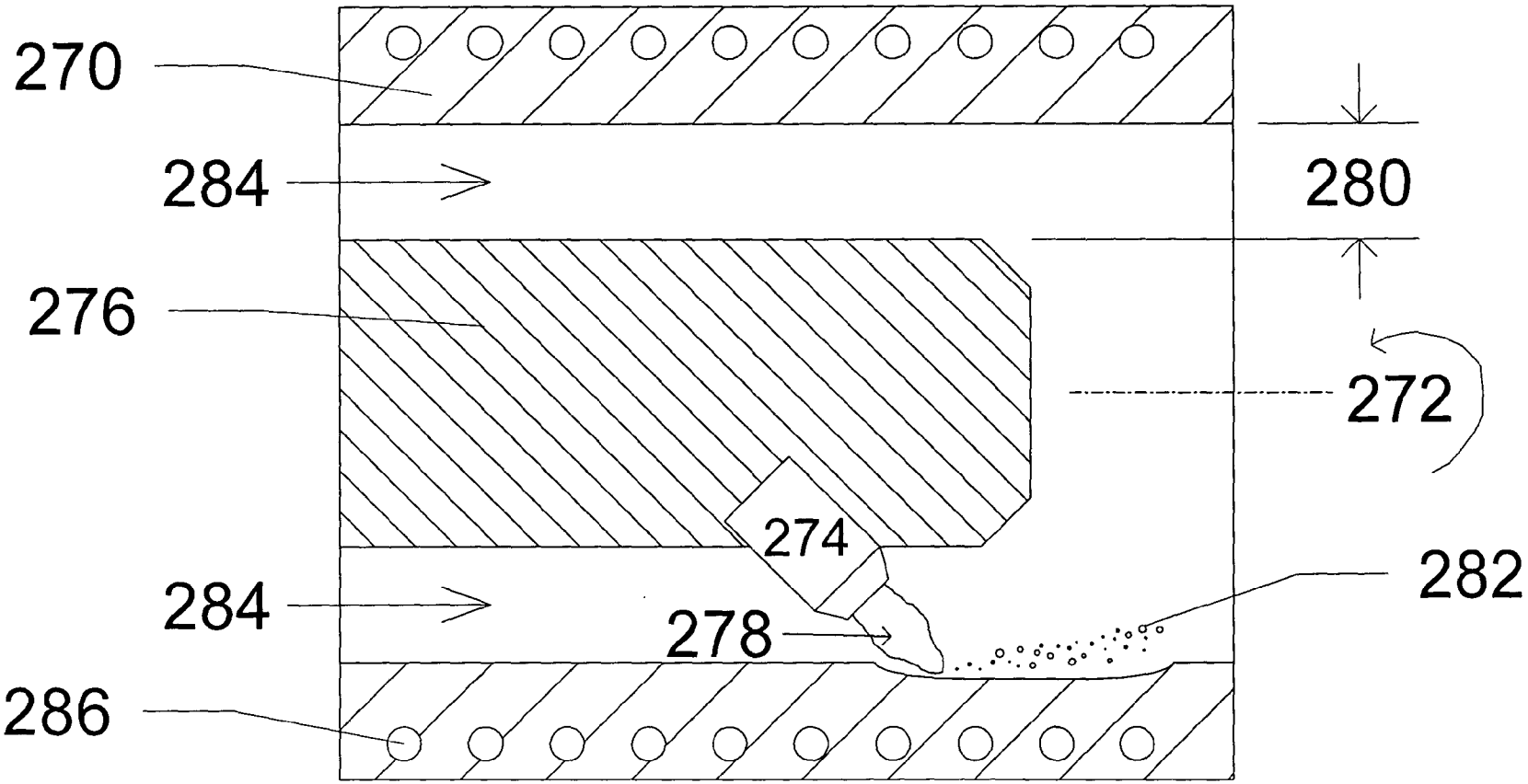
FIG. 19 illustrates the utilization of plasma torch heating as the liquefying technique used in accordance with the present invention.

Included among these are radiant heating, see FIG. 11, induction heating, see FIGS. 12 and 13, electric arc heating, see FIG. 14, laser melting, see FIG. 15, hot atomizing fluid, see FIG. 16, chemical reaction, see FIG. 17, external melt, see FIG. 18 and plasma arc, see FIG. 19. While a few of the acceptable heating techniques are discussed in greater detail below, it should also be understood and appreciated that certain selected material(s) may already be in the appropriate state and require no further manipulation.

In addition to the liquefying techniques discussed above, at least one other aspect should be noted at this time. In those circumstances indicated within Step A as external melt, none or "source"—meaning the material to be atomized is melted prior to being subjected to elevated acceleration—a potentially beneficial difference occurs. In these is cases there can be relative motion between the molten material and the inside surface of the rotating tube when the molten material is introduced to the tube. This motion can cause entrapment of atomizing fluid/gas between the molten material and the tube internal diameter resulting in elevated bubbling. These bubbles are the source of jet and film drops. This nuance is labeled A1, generally depicted herein as reference numeral 102. A conceptual diagram of this phenomenon was discussed above and further described as related to FIG. 7.

Step B, generally depicted herein as reference numeral 104, simply and directly states only that molten material be subjected to an elevated acceleration. While according to a preferred embodiment of the present invention, the acceleration is envisioned to occur on the inside diameter of a rotating tube, it should be noted and appreciated that it is conceivable that the same results could occur from another acceleration source e.g., a rocket sled.

Step C, generally depicted herein as reference numeral 106, stipulates that a fluid must pass over the surface of the melt to create disturbances. The "surface" in this case is the portion of the molten material closest to the center of the rotating tube. Another explanation: "surface" is the outer portion of the melt not in direct contact with a physical constraint. This step is akin to wind blowing over the surface of the ocean. Steps A–C are generally depicted in the cartoon illustrations of FIG. 6.

While the three steps discussed immediately above are distinct and independent steps as indicated by their denotation as Steps A, B and C, it should be understood and appreciated that a significant aspect of the present invention is the fact that steps A–C may occur in a different sequence or simultaneously both in whole and in part without escaping the scope of this invention.

Step C1, generally depicted herein as reference numeral 108, indicates the option of subjecting the material(s) and/or atomizing fluid to intentionally induced vibration. In accordance with one embodiment of the present invention, ultrasonic vibration inputs are used to enhance the output of conventional gas atomizers and as stand-alone systems to manufacture small quantities of very fine metal powder. In this particular embodiment of the present invention the vibratory inputs cause ripples on the melt surface leading to significant atomization and an increase in surface roughness. The increased roughness increases the energy imparted by the atomizing fluid on the melt resulting in elevated wave activity.

Step D, generally depicted herein as reference numeral 110, is a result of step C. The velocity difference between the melt and the atomizing fluid create loading and instabilities at the interface, i.e. shear stress and undulating eddy loading, between the atomizing fluid and the melt. These stresses result in the formation of waves, breakers, and whitecaps. The surface motions are ultimately manifested as spume drops, jet drops, and film drops.

Step E, generally depicted herein as reference numeral 112, simply and directly confirms that the earlier steps have generated drops and recognizes their existence. Given that drops have now been created, each drop will experience at least one of three avenues of progression. A drop will either 1) become directly aerosolized; 2) return to the melt; or 3) fragment into smaller droplets by secondary atomization.

It may be advantageous to briefly discuss each of these options. First, as denoted by Step E1 (generally depicted herein as reference numeral 114), if the droplets are ejected sufficiently far from the melt and are small enough that the atomization fluid viscosity is sufficient to prevent the particle from returning to the melt then atomization has been achieved. Secondly, as denoted by Step E2 (generally depicted herein as reference numeral 116), if each of the aforementioned circumstances is not met then the particle may return to the melt, whereby upon impact with the melt, causing splatters. Lastly, as denoted by Step E3 (generally depicted herein as reference numeral 118), in those circumstances where the Weber number is sufficient, the particle(s) may subsequently be subjected to secondary atomization while immersed in the atomization fluid.

It should be understood and appreciated that even though each of these options are individually discussed, in fact, there are certain droplets experiencing each one of these effects simultaneously. The relative amounts of each activity will be dependant upon the tuning variables of the process i.e. acceleration (both of the melt and atomization fluid), atomization fluid dynamic pressure, melt puddle thermodynamics, nozzle geometry, atomization fluid type, thermodynamic state and density, melt puddle geometry, atomizing material, and any vibration. Lastly, it should also be fully understood and appreciated that a variety of thermodynamic conditions, i.e. temperature, pressure, and density, of the atomizing fluid, as well as velocity (axial and angular) of the atomizing fluid are user selectable.

Step F, generally depicted herein as reference numeral 120, simply states and acknowledges that at least some of the drops produced aerosolize. Additionally, Step G, generally depicted herein as reference numeral 122, sets forth the fact that quickly after atomization the molten material seeks a minimum surface energy and the particle becomes spherical. Simultaneously the particle cools toward local temperature conditions through convection, conduction, and radiation heat transfer.

Step H, generally depicted herein as reference numeral 124, depicts that once the atomizing fluid and atomized material have been removed from the atomizer the two must be separated. This separation can be achieved through any number of well-known and accepted existing technologies, such as those used in the pollution abatement industry.

Step I, generally depicted herein as reference numeral 126, notes a recognition that under certain circumstances it may be desirable to further process the powder to alter the microstructure or change the particle size distribution to fulfill customer requirements. Again anything performed at this juncture may use any number of existing technologies without escaping the desired legal scope of the present invention.

Experiment Discussion

Given that the general steps involved in the present invention have been described above, a more specific description of two actual experiments that operates utilizing the novel aspects of the present invention will now be discussed.

A ϕ152 mm iron pipe was rotated on a lath. The interior surface of the pipe was subjected to the jet from a plasma torch. The lath rotated the tube at 60, 120 and 360 RPM (centripetal acceleration of 3, 12, and 108 $m/s^2$). The following was learned from these experiments.

1) The particles created at 360 RPM appeared to be smaller than those created at 60 RPM.
2) Most of the molten material did not atomize.
3) At higher rotational speeds the torch was less effective at melting the base material.
4) Based upon inspection of the inside surface of the pipe at test conclusion, it appeared that the plasma torch would melt the iron and eject it away from the melt area as a liquid ligament—much like what is seen in gas atomization.
5) Particles from 5 to 50 μm were made in these tests.

Figure 8:
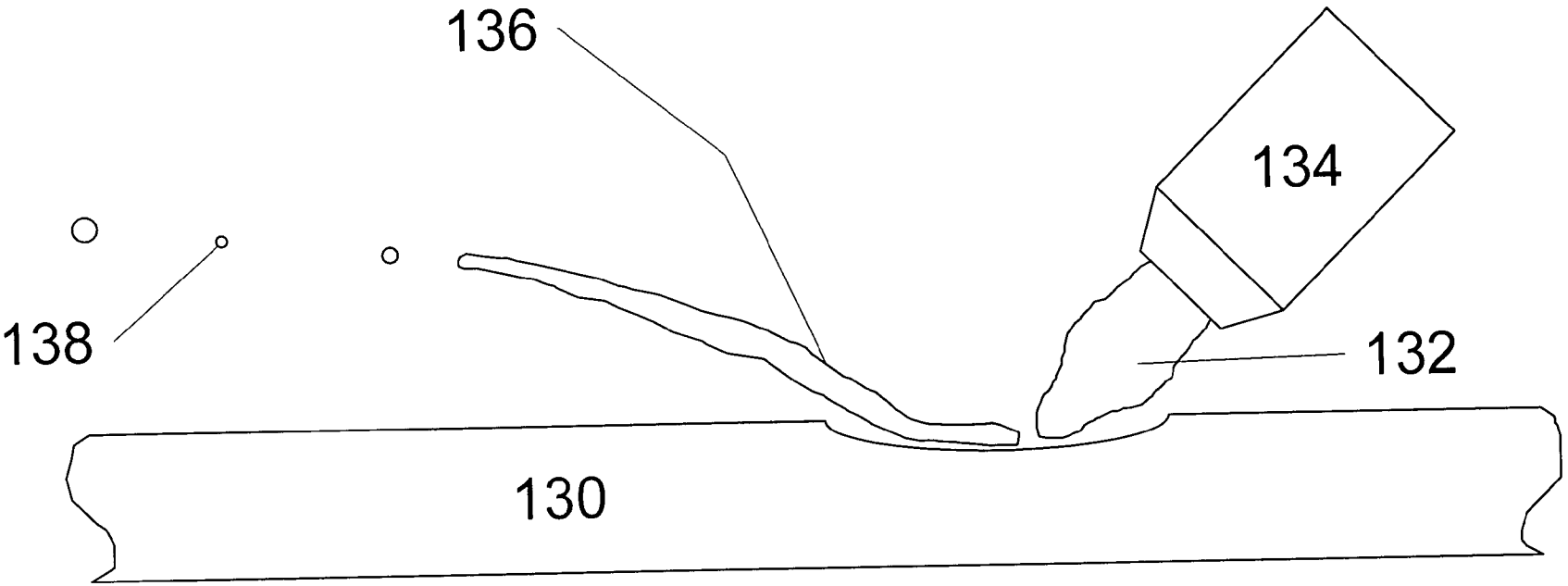
FIG. 8 depicts one type of structural set-up that was used to facilitate testing of certain aspects of the present invention.

While the particular components used to perform the experiment described above are not specifically depicted herein, FIG. 8 visually sets forth what likely occurs during such a pipe tests. Specifically, a base material 130 has a heat source, such as the jet 132 from a plasma torch 134, melt a selected area of the base material 130. As the base material 130 melts, a liquid ligament 136 separates from the selected area of the base material 130. Additionally, small particles became generated from the liquid ligament 136 and broke apart as droplets 138. Post-test visual evidence from the pipe test indicated that the plasma jet created ligaments of molten iron. It appears that in some cases these ligaments or spheres created from them were disintegrated in secondary atomization. The aforementioned secondary atomization apparently led to the production of at least some fine particles.

Figure 9:
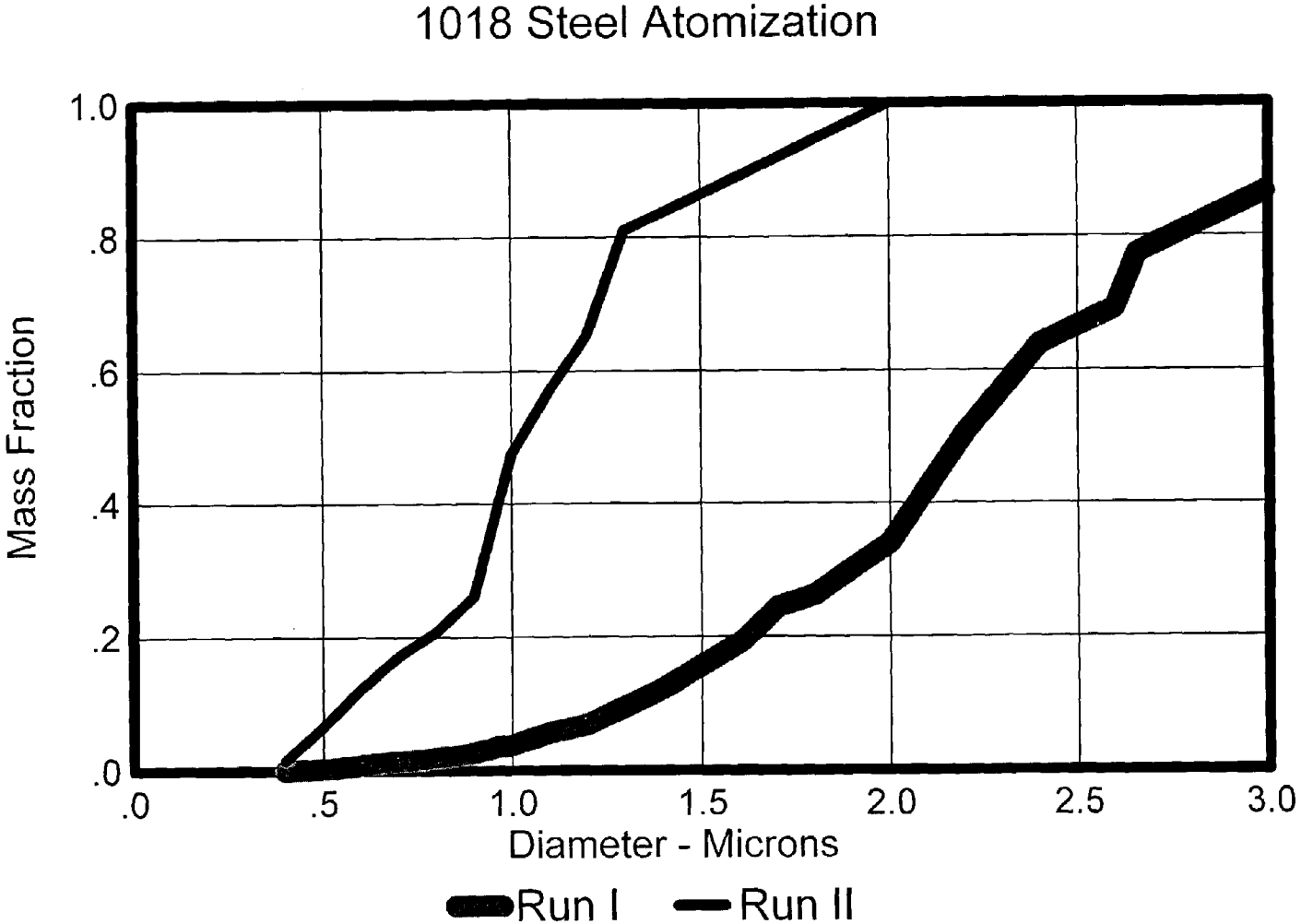
FIG. 9 graphically documents the results of two runs of the experimental structure depicted in FIG. 8.

As a result of the pipe test described above, a second test apparatus was built with a smaller (<40 mm) interior diameter and operated at as high a rotational speed as practical. This second apparatus was constructed, operated and data collected. Particle size data from a series of experiments with the second test apparatus is graphically set forth in FIG. 9. Specifically, FIG. 9 presents information about the particle results in the form of accumulated mass as a function of particle size.

In accordance with the present invention, two different runs of the second test apparatus described above were performed with 1018 steel as the base material being atomized. In both cases very fine particles, in the range of 0.5 to 3.0 μm were created. While the results of the two runs do not exactly match, the reason for the discrepancy is the difference in how the plasma jet impacted the inside surface of the rotating cylinder during the two runs. The particles created for these data are about 1/10 the size of the material currently being used commercially for powder injection molding applications. The actual apparatus used to obtain these data are described below.

Figure 10:
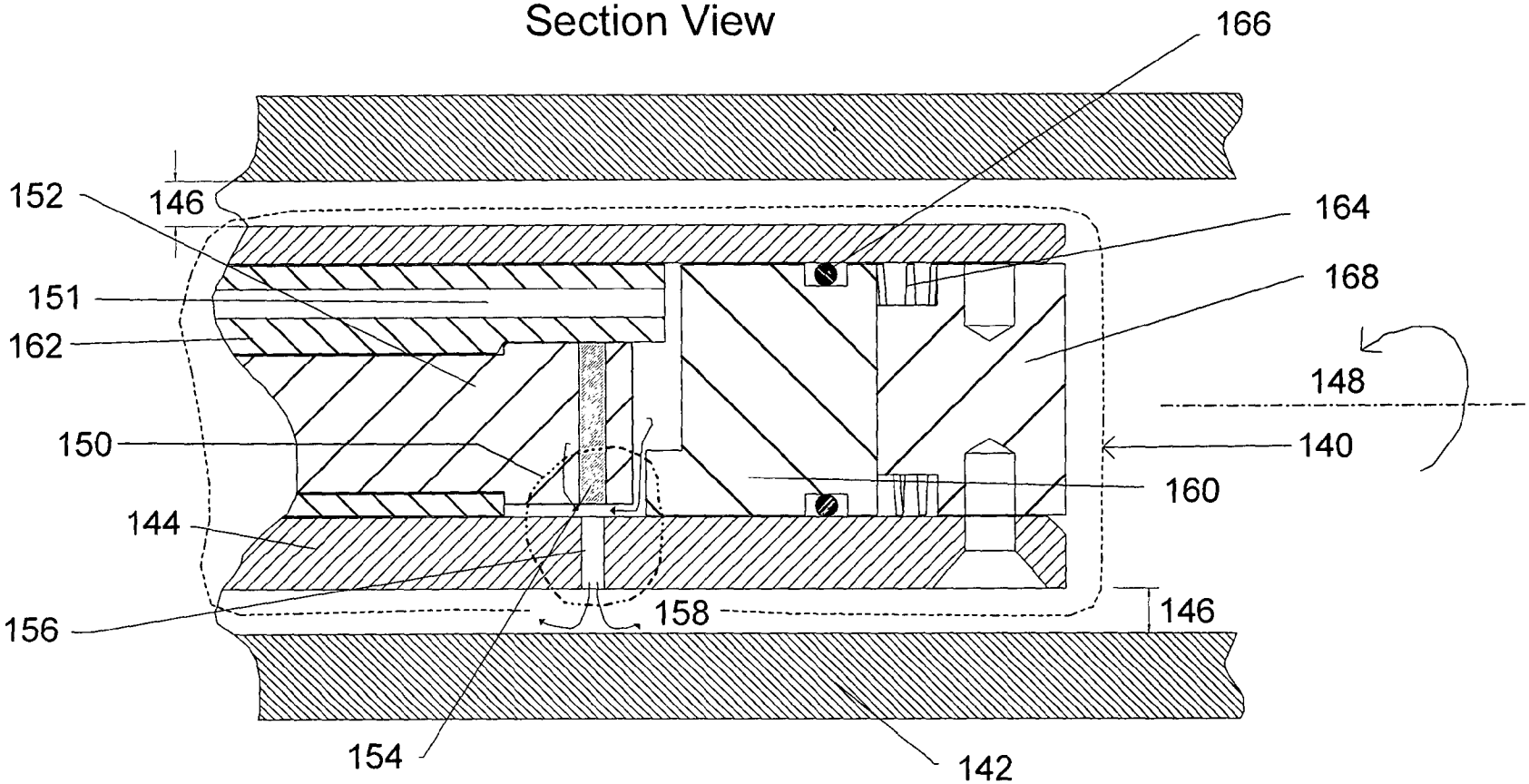
FIG. 10 visually depicts a sectional view of one embodiment of the present invention that generally incorporates a plasma torch unit positioned within a rotating tube.

FIG. 10 visually depicts a sectional view of one embodiment of the present invention that generally incorporates a plasma torch unit 140 positioned within a rotating tube 142. Specifically, the rotatable tube 142 is positioned and secured around a torch confinement unit 144 in a manner that establishes a nominal gap 146 between the inner radius of the rotatable tube 142 and the outer radius of the torch confinement unit 144. While the size of this nominal gap 146 may vary depending on the specific design structure selected to implement the present invention, an acceptable value for the nominal gap 146 in accordance with the specific embodiment illustrated in FIG. 10 is about 4.0 mm.

As noted in FIG. 10, the torch confinement unit 144 and the rotating tube 142 are concentrically aligned around a single axis of rotation, denoted herein as 148. Additionally, a heat source electrode 152 is located within torch confinement unit 144 in a manner that facilitates the heating of an atomizing fluid/gas 151 of some type that is positioned through the heat source 150. In the particular embodiment shown in FIG. 10, there is an electrode 152 within the center of the torch confinement unit 144 that is connected to a tungsten tip 154 of the heat source 150. Furthermore, an opening or vent hole 156 exist within the torch confinement unit 144 so as to allow the heated atomizing fluid/gas 151 to flow from the area immediately adjacent the heat source electrode 152 in an outwardly direction toward and into the nominal gap 146. For illustrative purposes, the path flow of the exiting atomizing fluid/gas is depicted as arrows 158. In the configuration shown, the opening or vent hole 156 is aligned with the tungsten tip 154.

The function of an arc plug 160 is to create a temporary short between the electrode 152 and the torch confinement unit 144 during the startup sequence. An insulator 162 assures electrical isolation between the electrode 152 and the torch confinement unit 144 except as noted above. A spring 164 assures electrical continuity from the electrode 152 to the torch confinement unit 144 through the arc plug 160 when unpressurized and allows movement of the arc plug 160 upon pressurization. An O-ring 166 seals the torch confinement unit 144. An end plug 168 entraps spring 164 to effectively confine the various components within the torch confinement unit 144. The vent hole 156 allows a path for atomizing fluid/gas to exit the torch confinement unit 144 and impinge upon the rotating tube 142.

As built and tested, the specific structure illustrated in FIG. 10 incorporated a rotating tube that was 25 mm interior diameter. Due to the relatively small scale of the particular atomization structure tested, existing commercial torches would not fit within the 25 mm diameter tube so a custom torch was designed and used. However, if larger scaled version of the atomizer design illustrated were used, commercial torches would likely be available that physically fit within the selected dimensions. The use of a custom torch in no way should be interpreted as a limitation of the scope of the present invention. Lastly, the specific power supply chosen for use in this particular embodiment of the present invention is a commercial (Miller 3080) plasma torch power supply.

Based on the particular atomizer structure discussed above, specifics of the initiation sequence of the experimental apparatus of this embodiment of the present invention will now be presented. First, the rotating tube is brought up to the desired speed of rotation. While the desired rotating speed is determined by the particular atomizing structure being used, the rotating speed in this embodiment is approximately 30,000 RPM.

Once the desired rotational speed is achieved, an electrical potential is applied to the electrode 152. Current flows from the electrode 152 through an arc plug 160 and returns to the power supply (not shown) through the torch confinement unit 144. Please note that the electrode 152 is electrically insulated from the remaining apparatus everywhere except at the arc plug 160, and that the electrode 152, arc plug 160, and torch confinement unit 144 are excellent electrical conductors (e.g. copper).

The supply of a selected atomizing fluid/gas is turned on so as to allow the selected atomizing fluid/gas 151 to flow through a vent hole 156 in the torch confinement unit 144. The presence of the atomizing fluid/gas 151 elevates the pressure within the torch confinement unit 144 and causes the arc plug 160 to be pushed away from the electrode 152 (to the right on the sketch). During this interval an arc forms between the electrode 152 and the arc plug 160. As a result of the arc, the atomizing fluid/gas 151 becomes ionized and electrically conductive.

Nitrogen is one of the acceptable atomizing fluid/gases that may be used in accordance with the present invention. However, it should be understood and appreciated that many different materials are suitable as the atomizing fluid/gas —including air. Nitrogen is a desirable choice because it is almost inert and is inexpensive.

Once the power supply senses low resistance between the electrode 152 and the rotating tube 142 (from ionized gas) the electrical path from the torch confinement unit 144 and the power supply is opened and the return path to the power supply is shifted to the rotating tube 142. At this time, the power supply dramatically increases the current thereby establishing an arc between the tungsten tip 154 and the rotating tube 142. The arc between the tungsten tip 154 and the rotating tube 142 acts to violently heat the atomizing fluid/gas as it exits opening or vent hole 156 within the torch confinement unit 144 into and through the nominal gap 146. Atomizing fluid/gas that has been heated to plasma heats the interior diameter of the rotating tube 142 and as a result causes melting closely followed by the formation of waves, breakers, whitecaps, film, spume, and jet drops.

Earlier, it was acknowledged that a number of existing liquefying techniques could be used in accordance with the present invention to achieve Step A of the flow chart detailed above. A few of these liquefying techniques are now discussed in greater detail below.

Radiant Heating, see FIG. 11—In general, the central portion of an annulus would be replaced by a heating element 170. Heat would be transferred by thermal radiation and convection from the heating element 170 to the surface of a rotating cylinder 172.

The inside surface of the rotating cylinder or rotor 172 melts and remains as a liquid metal 174 physically positioned against the inner surface of the rotor 172 when the rotor is spinning. While the rotor 172 is spinning, an atomizing fluid/gas 176 is introduced between the heating element 170 and the liquid metal 174 such that the atomizing fluid/gas 176 flows across the surface of the liquid metal 174. In this particular embodiment the atomizing fluid/gas 176 flows along a path depicted herein as 176. Lastly, coolant ducts 178 may also be incorporated into the rotor 172 as needed or desired.

Heating elements are commercially available from several manufacturers. Since there is no direct physical contact between the melt and the heating element, the risk of contamination is minimal. The placement and intensity of heat can be controlled closely.

Induction Heating—Faraday's law predicts that when a material is subjected to a time varying magnetic field, a voltage will be induced resulting in a current. These electric currents form circles called eddy currents. Since no material is a prefect conductor, these induced electric currents will result in heating of the parent material.

As shown in FIG. 12, induction heating may be achieved with a rotating cylinder or rotor 180, possibly with a coolant device such as ducts 182 incorporated therein, and a coil 184 positioned within the rotor 180 that the user may shape to duct atomizing fluid as deemed appropriate. As with other heating methods, the interior surface of the rotor 180 melts and remains as a liquid metal 186 physically positioned against the inner surface of the rotor 180 when the rotor is spinning. While the rotor 180 is spinning, an atomizing fluid/gas 188 is introduced between the coil 184 and the liquid metal 186 such that the atomizing fluid/gas 188 flows across the surface of the liquid metal 186.

With an induction heating technique, a current is introduced into the coil 184 thereby creating a magnetic flux 192 that results in an induced current 190 in the interior of the rotor 180. As stated above, the presence of the induced current 190 and magnetic flux 192 result in heating both the rotor 180 and its melted interior surface (liquid metal 186).

Another means to inductively heat the tube interior surface is by transverse flux induction heating. This approach is illustrated in FIG. 13. Here a magnetic pole 500 (either stationary or rotating) is mounted in the center of the rotor 502. A magnetic pole of opposite polarity 504 is located around the outside circumference of the rotor 502. Magnetic flux passes between the interior magnetic pole 500 and the exterior magnetic pole 504 through a gap 508 and the rotor 502.

The gap 508 between the interior magnet pole 500 and the rotor 502 may be uniform around the circumference when using a time varying magnetic field 506 or spatially varying (shown) for a non-time varying magnetic field 506.

The changing magnetic field 506 seen on the interior surface of the rotor 502 induces eddy currents, heats the inside surface of the rotor 502 resulting in melt 510.

As with all other melting schemes described herein a atomizing fluid 512 is passed through the gap 508 between the rotor 502 and the magnetic pole 500 to achieve atomization. In this circumstance like the other heating approaches it may be necessary to cool the rotor 502 by coolant ducts 514.

The advantage of either version of the induction heating approach is that the rotating tube can be sacrificial; there is a minimum of wasted energy, and the melt source material doubles as the containment. Such a design reduces the opportunity for contamination.

Electric Arc Heating—Another common method to create molten metal is with an electric arc. Shielded metal arc welding (stick welding) is an example. This approach is also used to create molten metal in metal manufacturing.

In this embodiment of the present invention, a center portion of an annulus contains an electrode 194 has a given electrical charge or polarity while a rotating cylinder 196 is electrically charged oppositely, see FIG. 14. As with other heating methods, the interior surface of the rotor 196 melts and remains as a liquid metal 198 physically positioned against the inner surface of the rotor 196 when the rotor is spinning. While the rotor 196 is spinning, an atomizing fluid/gas 200 is introduced between the electrode 194 and the liquid metal 198 such that the atomizing fluid/gas 200 flows across the surface of the liquid metal 198.

Additionally, the rotor 196 and/or the electrode 194 in the annulus center may be sacrificial. As shown, the rotor 196 is sacrificial therefore the liquid metal 198 forms on the interior of rotor 196. However, if the electrode 194 were sacrificial, a liquid metal layer would form on the external surface of the electrode 194 and deposited by free fall onto the interior rotor surface 196.

In accordance with the present invention, the electrical current used may be either AC or DC. Like induction or radiation heating techniques discussed above, this method allows the molten material to never come in contact with a dissimilar material, and coolant ducts 202 may also be incorporated into the rotor 196.

Laser Melting—Lasers have become a widely accepted energy source for welding, surface treating, and etching. As shown in FIG. 15, a laser 204 is used as the heat source to create a puddle of liquid metal or molten material 206 on the inside surface of the rotating cylinder or rotor 208 suitable for atomization. As before, the design of the rotor 208 and the positioning of the liquid metal 206 and atomizing fluid/gas 210 are similar to that described above with regard to radiant heating and induction heating. As a result, particles 212 separate from the sacrificial material of the rotor 208 or possibly an annulus center 214. As with other heating techniques, coolant ducts 216 may also be incorporated into the rotor 208 or annulus center 214.

The advantages of this approach include its ability to accurately control the location of the energy application using existing technology. It also allows a wide range of atomizing fluids, and like induction and radiant heating, the source material is the containment; therefore, the opportunity for melt contamination by the containment is minimal.

High Temperature Fluid—In another embodiment of the present invention, a sufficiently preheated atomizing fluid/gas 220 serves the dual purpose of melting the interior surface of the rotor 222 and thereby creating a molten material or liquid metal 224 see FIG. 16. This method of heating could be by the combustion of fuels or by an electric arc as is the practice with plasma welding or some other means. Once again, the design of the rotor 222 and the positioning of the liquid metal 224 and atomizing fluid/gas 220 are similar to that described above with regard to radiant heating and induction heating. Additionally, a material 226 is positioned within the center of the rotor 222 for the purposes of directing the flow of the atomizing fluid to the interior diameter of the rotor. As with other heating techniques, coolant ducts 228 may also be incorporated into the rotor 222 or centrally positioned refractory material 226.

Chemical Reaction—Instead of heating the metal and passing an inert gas over the molten material to create bubbles, one embodiment of the present invention uses a rotor 230 made of a metal oxide and then pass a fuel or atomizing fluid/gas 232, such as $H_2$, over the surface thereby creating a layer of liquid metal 234, see FIG. 17. In this case the metal oxides rotor 230 reacts with the fuel 232 forming metal, water and heat. As a result, metal powder 236 is produced in addition to water and combustion products.

Once again, the design of the rotor 230 and the positioning of the liquid metal 234 and fuel or atomizing fluid/gas 232 are similar to that described above with regard to radiant heating and induction heating. Additionally, a refractory material 238 is positioned within the center of the rotor 230. As with other heating techniques, coolant ducts 240 may also be incorporated into the rotor 230 or centrally positioned refractory material 238.

External Melt Source or Liquid at Ambient Temperature—FIG. 18 illustrates yet another structural embodiment for implementing the present invention wherein an external melt source or liquid is used. The general operational basis of this particular embodiment of the present invention is that the material to be atomized is melted by an external source 250, introduced into a rotating cup 252, accelerated, atomizing fluid/gas 254 is passed over the surface of the molten material and atomized occurs as described previously.

In this case there can be a large velocity difference between the introduced liquid and the containment. A benefit of this approach is this velocity difference will lead to mammoth entrapment of atomizing fluid/gases within the melt.

The advantage of building the apparatus in this manner is that the geometry can be controlled much better than in those circumstances where either the center of the annulus or the cylinder are sacrificial. However, this approach risks contamination of the melt with the containment material.

Structurally, a motor 256 is connected to a refractory material unit 252 so as to spin the refractory material as desired. A stator portion 258 is securely positioned within an upwardly (though in the particular drawing it is upward, it should be understood and appreciated that many different orientations are acceptable in accordance with the present invention) opened recess of the rotating cup 252 such that the stator 258 does not touch the rotating cup 252, thereby establishing and maintaining an opening 260 there between. Additionally, a fluid entry path 262 passes through the stator 258 and provides means to introduce fluid from above the stator 258 into the opening 260 between the stator 258 and the rotating cup 252. An additional melt entry path 262 also passes through the stator 258 and provides means to introduce fluid from above the stator 258 into the opening 262 between the stator 258 and the rotating cup 252. A particulate capture unit 266 is arranged above the upwardly directed ends of opening 260 so as to receive aerosol material 264 resulting from the atomization process that occurred within opening 260. It should be noted and appreciated that the stator portion 258 may remain stationary or configured to spin depending on the desires of the manufacturer. The term "motor" as used in relation to all embodiments described herein is intended to generally describe the source of rotational power to the centrifuge and is used to mean any source of rotational power.

The remaining method of melting the interior surface is the technique employed to obtain the preliminary data (FIG. 10)—plasma torch heating—FIG. 19.

As is the case with the previous atomization heating methods, in this case a rotor 270 rotates about an axis 272. A plasma torch 274 positioned by a positioner 276 on the inside on the inside surface of the rotor 270. The torch 274 forms a plasma jet 278 that after traversing a gap 280 impinges upon the inside surface of the rotor 270 melting the surface, creating a disturbance on the melt and ultimately resulting in the formation of aerosolized particulates 282 by means already discussed.

A novelty to the embodiment is that the use of atomization fluid 284 is optional and at the discretion of the manufacturer. Furthermore, with this embodiment the radial component of the plasma gas will exert dynamic pressure normal to the melt. This additional loading acts in addition to and in the same direction as the melt gravitational loading from the melt inertia. Both effects act to reduce the melt depth (see d FIG. 6) and improve the opportunity to produce smaller particles. As before provisions to cool the rotor 270 through a heat exchanger 286 are available.

As stated earlier, the categorizations described above are not exclusive. Combinations of the various categories can occur e.g. an atomizer could be constructed where it is manufactured from a refractory and heated with a radiant heating element or induction heating.

While significant details have been provided regarding a number of different embodiments of the present invention, there are other novel aspects of the present invention that may be incorporated without escaping the scope of the present invention. A few of the possible additional embellishments to the underlying premise of the present invention are briefly discussed below.

Aerosolized Atomizing Fluid

As mentioned previously the atomizing fluid may be a liquid or gas reactive or inert. Additionally, in accordance with the present invention, the fluid may contain aerosolized particles of the composition being atomized or some other material. This option provides the opportunity for enhanced splashing, a means of recycling undesired product, creating alloys, as well as spawning the opportunity to create encapsulated powders.

Melt/Containment Relative Motion

When a cylindrical containment is rotating, relative motion between the melt and the containment can occur two ways: by inter fluid shear between the melt and the atomizing fluid, and components of acceleration not normal (perpendicular) to the melt surface. Relative motion is desirable because it leads to pinching entrapment of atomizing fluid/gases between the melt and containment.

Figure 20:
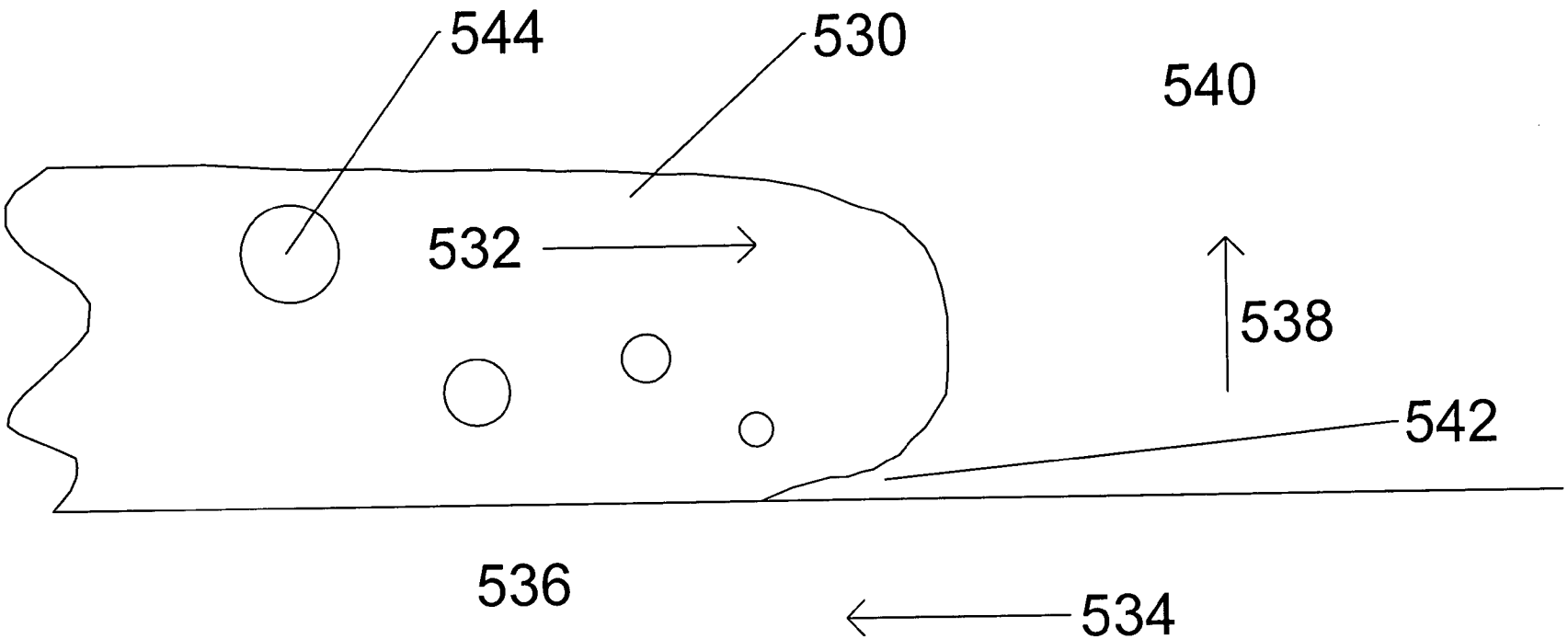
FIG. 20 illustrates how pinch entrapment of atomizing fluid into the melt can occur.

FIG. 20 is an illustration that depicts how pinch entrapment of atomizing fluid into the melt can occur. As shown herein, the melt 530 is moving with a velocity 532 that is different from the containment velocity 534. The melt is supported by the containment 536 that reacts with the melt centrifugal loads from centripetal acceleration 538. Such a situation leads to entrapment of the atomizing fluid 540 at a pinch point 542 and ultimately the formation of bubbles 544. Entrapped atomizing fluid/gases within the melt result in the formation of film and jet drops that are considerably smaller than the spume drops formed at the wave crests.

In all of the atomization structures and scenarios discussed with regard to the present invention, fluid passes over the surface of a liquid when that liquid is subjected to elevated acceleration. This relative fluid movement will subject the melt to shear stress thus urging the melt to move. The containment is rigid and will not move as a result of aerodynamic shear. Under these conditions, the liquid will move relative to the containment allowing pinching entrapment to occur.

In those circumstances where the rotor is not the source of the melt the opportunity exists for the melt and rotor to contact at different angular velocities. The different speeds will (temporarily) result in relative motion between the introduced melt and the rotor. This difference will enable the entrapment of atomizing fluid/gases as described earlier.

Multiple Axis Rotation

While the most basic implementation of the present invention may be directed toward structures establishing rotation around a single axis, it should be noted and fully appreciated that the present invention additionally envisions structures that facilitate rotation on more than one axis. Generally speaking, the two configurations that are most practical to achieve multiple axes rotation are referred to herein as a parallel-axes dual centrifuge atomizer and a perpendicular-axes dual centrifuge atomizer. The motive behind the multiple axes rotation initiative is the desirability to facilitate relative motion between the containment structure and the melt.

To further describe and clarify the multiple-axes rotation aspect of the present invention, four sketches (FIGS. 21–24) are presented that pictorially describe at least some of the acceptable means that may be used to subject a melt to tangential acceleration.

However, before specifically discussing these four sketches, it may be beneficial to address some general aspects. As used herein, tangential means that component of the acceleration not normal to the inside circumference of the primary centrifuge. Additionally, as it relates to the present invention two types of acceleration are discussed: centripetal and Coriolis. Centripetal acceleration is measured at a point on a body of rotation and its direction is always toward the axis of rotation. In the cases where multiple rotational axes the acceleration at a point will be the vector sum of the accelerations about the axes. This vector sum can be represented as the sum of two vectors: one normal to the surface of the melt and one perpendicular to that normal vector (see FIGS. 22 & 24).

The perpendicular acceleration component is akin to what you experience when you accelerate your car. You're still accelerated toward the Earth at (9.8 $m/s^2$) but now an additional acceleration component perpendicular (assuming you're on a flat surface) to Earth's gravitation is also present. The vector sum of these is the total acceleration.

In accordance with the present invention, it is recognized that this perpendicular component is unique to the multiple axes rotational situation; it facilitates the movement of melt relative to the containment surface even in those circumstances where the melt source is the containment. Relative movement is good; it leads to entrapped atomization fluid resulting in melt bubbles. Lastly, in one embodiment of the present invention, this perpendicular component is specifically referred to herein as "tangential acceleration" $A_t$.

Figure 21:
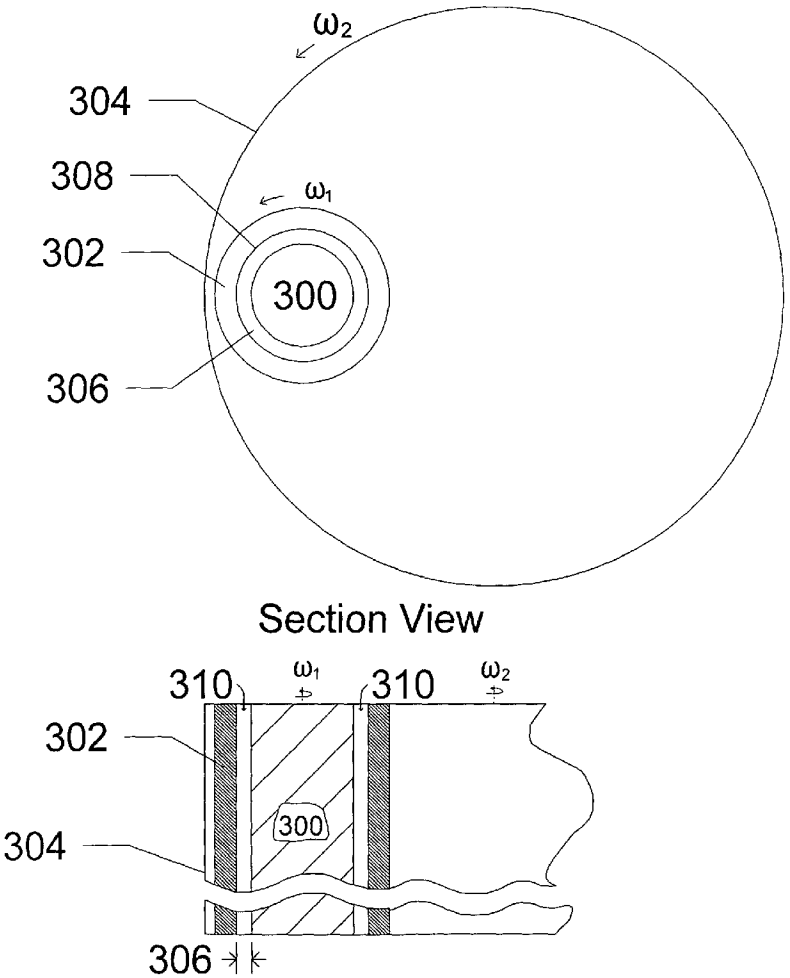
FIG. 21 illustrates one embodiment of the multiple-axes rotation aspect of the present invention, specifically a parallel-axis, dual centrifuge design.

The first configuration of a multiple-axes rotation aspect of the present invention is set forth in FIG. 21. In one particular embodiment of the present invention as shown in FIG. 21 a heat source 300 and a primary centrifuge 302 are located at some radius on a secondary centrifuge 304. The axis of rotation of the primary centrifuge 302 is parallel to the rotational axis of the secondary centrifuge 304. In accordance with the present invention, the primary centrifuge 302 acts as a melt containment unit and in one embodiment may be a rotating tube. Additionally, the secondary centrifuge 304 may be designed as a rotating platform.

Also depicted in FIG. 21 is a fluid flow annulus 306 established between the heat source 300 and the inner radius of the primary centrifuge 302. A "Surface Point," identified herein as reference numeral 308, illustrates the specific location of the acceleration vectors depicted in FIG. 22. A different location of the surface point would change the orientation of the vectors. The lower portion of FIG. 21 is a cross-sectional view of the upper portion to more clearly set forth the relationship of the various components of this embodiment of the present invention including the flow of the atomizing fluid 310.

As used herein, the rotational velocity of the primary centrifuge 302 is denoted as $\omega_1$ while the angular velocity of the secondary centrifuge 304 is denoted herein as $\omega_2$. Additionally, the radius of the primary centrifuge 302 is denoted herein as $R_1$, while the radius of the secondary centrifuge 304 is denoted herein as $R_2$.

Figure 22:
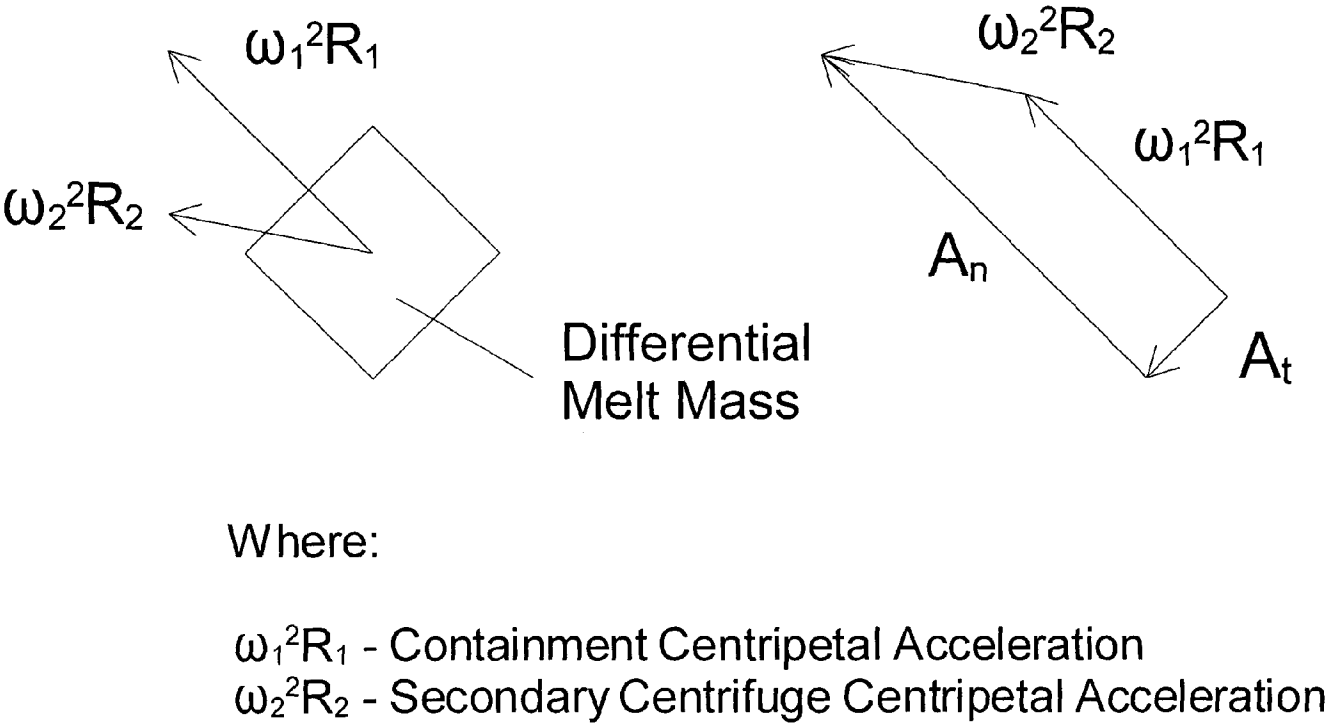
FIG. 22 graphically depicts the total surface point acceleration conditions of a parallel-axis, dual centrifuge design embodiment of an atomizer of the present invention.
Figure 23:
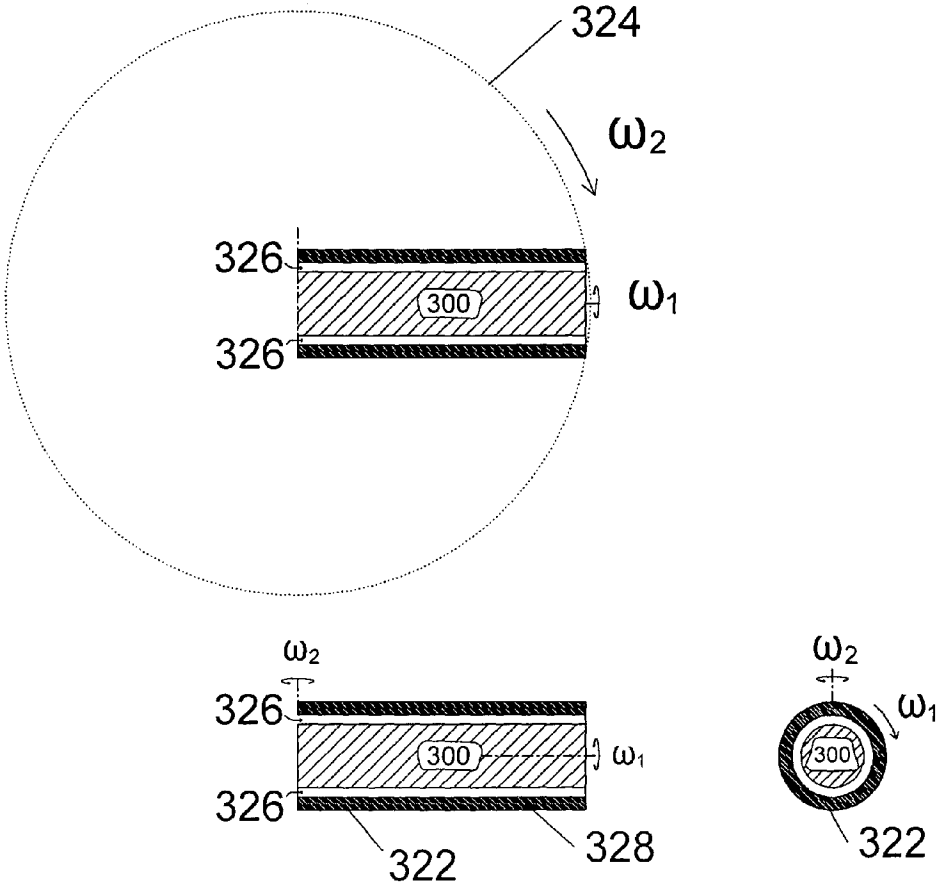
FIG. 23 illustrates one embodiment of the multiple-axes rotation aspect of the present invention, specifically a perpendicular-axis, dual centrifuge design.

To further explain the present invention and specifically the effect on the fluid or melt at an arbitrary location, FIG. 22 is presented. Specifically, FIG. 22 illustrates how the centripetal acceleration from the primary, or melt containment, centrifuge, depicted as vector $\omega_1^2R_1$, is graphically combined with the centripetal acceleration from the secondary centrifuge, depicted as vector $\omega_2^2R_2$. The sum of these vectors can be graphically portrayed as two distinct acceleration vectors, depicted herein as $A_n$ and $A_t$. Specifically, a first vector herein referred to as normal acceleration vector $A_n$ is representative of the portion of the vector sum that is perpendicular or normal to the inside surface of the primary centrifuge 302 while a second vector herein referred to as tangential acceleration vector $A_t$ is representative of the portion of the vector sum that is tangentially oriented relative to the inside surface of the primary centrifuge 302.

As a result of the multiple-axes rotation structure described above, additional forces are created on the melt which further assist in the formation of fine particles through the utilization of an elevated acceleration. More specifically, the tangential acceleration $A_t$ causes the melt to move relative to the wall surface. This movement leads to atomizing fluid/gas entrapment between the melt and containment that elevates the quantity of bubbles produced. Additional bubbling leads to a greater proportion of the drops being either film or jet sourced i.e. from smaller droplet formation mechanisms.

In addition to the parallel-axes dual centrifuge configuration discussed above, FIG. 23 illustrates an alternative embodiment in accordance with the present invention, namely a perpendicular-axes dual centrifuge configuration. A structural configuration where the primary centrifuge 322 is rotated 90° relative to secondary centrifuge 324 and allowed to lie flat in the plain of the secondary centrifuge, i.e. rotating platform, is illustratively described in FIG. 23. In a perpendicular-axes dual centrifuge configuration, atomizing fluid 326 flows radially outward relative to the rotating axis of the secondary centrifuge. Again, it should be understood that the angular velocity of the primary centrifuge 322 is depicted as $\omega_1$ while the angular velocity of the secondary centrifuge 324 is shown as $\omega_2$. The heat source 300 is the same as illustrated in FIG. 21.

Figure 24:
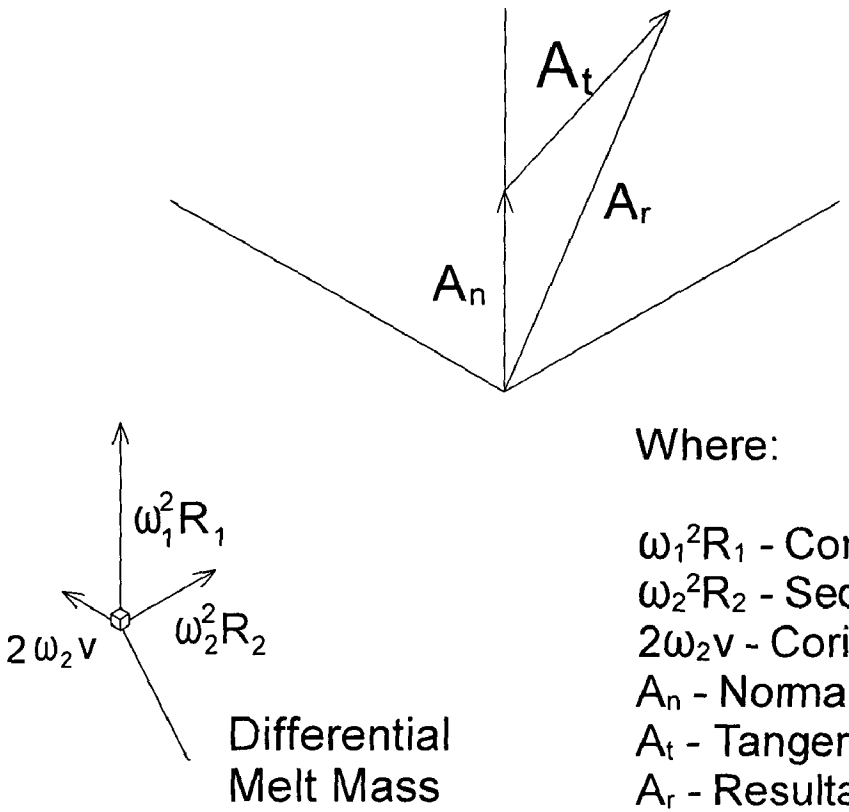
FIG. 24 graphically depicts the total surface point acceleration conditions of a perpendicular-axis, dual centrifuge design embodiment of an atomizer of the present invention.

The acceleration (FIG. 23, element 328) seen by an element of melt at an arbitrary location within perpendicular-axes dual centrifuge configuration is depicted in FIG. 24. In such a configuration, there are two types of accelerations that influence the melt movement, namely centripetal and Coriolis (perpendicular to one another). The sum of these accelerations causes movement of melt relative to the containment. It should be noted and understood that normal acceleration ($A_n$) presses the melt onto the containment wall as before.

This perpendicular-axes dual centrifuge configuration poses both opportunities and challenges. First there is the added benefit of Coriolis acceleration to aid in the movement of the melt. One challenge is the positioning of the angular momentum vector of the primary centrifuge. When operating in this configuration, the primary centrifuge places a torque on the secondary centrifuge (i.e. rotating platform) according to the formula:

$T=dL/dt$

Where:

T—Torque

L—Primary Centrifuge Angular Momentum t—time

The torque T can be substantial thereby requiring a robust structure. An alternative is to place an angular momentum source on the secondary centrifuge in a manner that cancels out the angular momentum of the primary centrifuge.

In accordance with the present invention, one could use the concept of a "dual centrifuge" where the axis of rotation between the primary and secondary centrifuges is an angle other than 0° or 90°. The analysis of the system would be essentially the same as for the perpendicular-axes configuration except elevated in complexity.

Additionally, in accordance with additional embodiments of the present invention, this concept may be taken one step further and have the secondary centrifuge rotating on two or more axes using a gimbaled mounting arrangement.

Although earlier descriptions and figures show a "heat source" as part of the embodiment, there is nothing about multiple rotational axes that requires heating if the material to be atomized may be brought to a liquid state by some other means. This would be analogous to the external melt source embodiment described earlier for the single axis machines.

The temperature and pressure of the atomizing fluid for any version of atomizer described herein are left to the discretion of the operator. There is nothing about this process that requires the atomizing fluid to be at atmospheric pressure or at ambient temperature.

As discussed throughout, the present invention relates to a process for atomizing a dispersible liquid material. In the present description a "dispersible liquid material" is intended to mean any material that is liquid at ambient temperature or at a temperature higher than the ambient temperature. Such a material includes especially water, a metal, fuel, an alloy, or a synthetic (for example thermoplastic) substance, for alimentary, pharmaceutical, cosmetic, agricultural, or similar use. In the case where the dispersible liquid material is a metal, it should be understood and appreciated that any known metals may be used in accordance with the present invention. The material may also be in the form of a mixture. In the description which precedes or which follows, the term "dispersible liquid material" should be understood to be a single material or a mixture of is materials. For the purposes of brevity "dispersible liquid material" is frequently referred to as "melt" in this text Additionally, for the purposes of preventing confusion from the verbiage used herein, the following definitions are also provided to further clarify the accepted meanings of certain words. As used in discussing the present invention, "fluid" refers to a substance (liquid or gas) tending to flow or conform to the outline of its container. "Gas" refers to a fluid that has neither independent shape nor volume but tends to expand indefinitely. "Liquid" identifies neither a solid or gaseous material characterized by free movement of the constituent molecules among themselves but without a tendency to separate. "Refractory" as used herein is intended to mean a material that melts well above the material being atomized. Lastly, aerosol, as used herein, is understood and appreciated to mean as a suspension of fine solid or liquid particles in a fluid.

Although the present invention has been described with reference to a preferred embodiment, the invention is not limited to the details thereof. Modifications that may occur to those skilled in the art are intended to fall within the spirit and scope of the invention as defined in the appended claims.

What is claimed is:

1. An atomizer system comprising:

a melt material to be atomized;

a containment portion for securing the melt material;

a unit which accelerates the melt material such that the melt material experiences an acceleration force higher than Earth's standard gravitational force; and atomizing fluid that flows across an exposed surface of the melt material, the exposed surface of the melt material being located within the containment portion;

wherein the containment portion and the unit which accelerates the melt material are operative to prevent the melt material from being ejected from the containment portion due to the acceleration force; and wherein, while the melt material is experiencing the acceleration force, liquid droplets of the melt material become entrained in the atomizing fluid flowing across the exposed surface of the material such that at least some of the liquid droplets aerosolize and are ejected from the containment portion.

2. The atomizer system of claim 1 further comprising means for introducing relative motion between the containment portion and the melt material.

3. The atomizer system of claim 1 wherein the melt material is rotated about more than one axis.

4. The atomizer system of claim 1 wherein the melt material is introduced into the containment portion as a liquid as the containment portion is being moved by the unit which accelerates the melt material.

5. The atomizer system of claim 1 wherein the unit accelerating the melt material is a centrifuge.

6. The atomizer system of claim 1 further comprising a source of vibration to introduce disturbances within the melt material.

7. The atomizer system of claim 1 wherein the flow of atomization fluid is continuous.

8. The atomizer system of claim 1 wherein the containment portion is made of a solid form of the melt material itself.

9. The atomizer system of claim 1 wherein the atomizing fluid is a gas.

10. The atomizer system of claim 9 wherein the gas that is the atomizing fluid is inert.

11. The atomizer system of claim 9 wherein the gas that is the atomizing fluid is oxidizing.

12. The atomizer system of claim 9 wherein the gas that is the atomizing fluid is reducing.

13. The atomizer system of claim 1 wherein the atomizing fluid is a liquid.

14. The atomizer system of claim 13 wherein the liquid that is the atomizing fluid is inert.

15. The atomizer system of claim 13 wherein the liquid that is the atomizing fluid is oxidizing.

16. The atomizer system of claim 13 wherein the liquid that is the atomizing fluid is reducing.

17. The atomizer system of claim 1 wherein the atomizing fluid contains particulates therein.

18. The atomizer system of claim 1 wherein the thermodynamic conditions, i.e. temperature, pressure, and density, as well as velocity (axial and angular) of the atomizing fluid are user selectable.

19. The atomizer system of claim 1 further comprising a cooling system.

20. The atomizer system of claim 1 further comprising a liquefying system that liquefies the melt material prior to introducing the melt material to the containment portion.

21. The atomizer system of claim 20 wherein the liquefying system applies radiant heating to the melt material to be atomized.

22. The atomizer system of claim 20 wherein the liquefying system applies induction heating to the melt material to be atomized.

23. The atomizer system of claim 20 wherein the liquefying system applies electric arc heating to the melt material to be atomized.

24. The atomizer system of claim 20 wherein the liquefying system applies lasers to the melt material to be atomized.

25. The atomizer system of claim 20 wherein the liquefying system applies hot atomizing fluid heating to the melt material to be atomized.

26. The atomizer system of claim 20 wherein the liquefying system applies chemical reaction heating to the melt material to be atomized.

27. The atomizer system of claim 20 wherein the liquefying system applies refractory containment heating to the melt material to be atomized.

28. The atomizer system of claim 20 wherein the liquefying system applies plasma arc heating to the melt material to be atomized.

29. The atomizing system of claim 1 wherein, while the melt material is experiencing the acceleration forces, portions of the atomizing fluid become entrapped within the melt material such that the portions of the atomizing fluid within the melt material buoyantly travel to the exposed surface of the melt material and form at least some of the liquid droplets of the melt material.

30. The atomizing system of claim 1 wherein the atomizing fluid that entrains the liquid droplets of the melt material flows in a direction substantially parallel to an axis of rotation of the containment portion.

31. The atomizing system of claim 30 wherein the containment portion is a cylinder.

32. A method of atomizing a melt material comprising the steps of:

accelerating the melt material to be atomized:

flowing an atomizing fluid across an exposed surface of the melt material while the exposed surface of the melt material is experiencing an acceleration force higher than Earth's standard gravitational force: and while the exposed surface of the melt material is experiencing the acceleration force, entraining liquid droplets of the melt material in the atomizing fluid flowing across the exposed surface of the melt material such that the liquid droplets aerosolize and create fine particulates;

wherein the atomizing fluid contains particulates therein.

33. A method of atomizing a melt material comprising the steps of:

accelerating the melt material to be atomized;

flowing an atomizing fluid across an exposed surface of the melt material while the exposed surface of the melt material is experiencing an acceleration force higher than Earth's standard gravitational force;

while the exposed surface of the melt material is experiencing the acceleration force, entraining liquid droplets of the melt material in the atomizing fluid flowing across the exposed surface of the melt material such that the liquid droplets aerosolize and create fine particulates; and entrapping portions of the atomizing fluid within the melt material such that, while the melt material is experiencing the acceleration forces, the portions of the atomizing fluid within the melt material buoyantly travel to the exposed surface of the melt material and form at least some of the liquid droplets.

* * * * *